US010435993B2

(12) United States Patent
Steele

(10) Patent No.: US 10,435,993 B2
(45) Date of Patent: Oct. 8, 2019

(54) JUNCTION ISOLATION TOOL FOR FRACKING OF WELLS WITH MULTIPLE LATERALS

(71) Applicant: Halliburton Energy Services, Inc., Houston, TX (US)

(72) Inventor: David Joe Steele, Arlington, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/764,774

(22) PCT Filed: Oct. 17, 2016

(86) PCT No.: PCT/US2016/057411
§ 371 (c)(1),
(2) Date: Mar. 29, 2018

(87) PCT Pub. No.: WO2017/074733
PCT Pub. Date: May 4, 2017

(65) Prior Publication Data

US 2018/0283140 A1 Oct. 4, 2018

Related U.S. Application Data

(60) Provisional application No. 62/246,473, filed on Oct. 26, 2015.

(51) Int. Cl.
*E21B 41/00* (2006.01)
*E21B 43/26* (2006.01)
(Continued)

(52) U.S. Cl.
CPC ..... *E21B 41/0035* (2013.01); *E21B 33/12* (2013.01); *E21B 43/26* (2013.01); *E21B 23/02* (2013.01)

(58) Field of Classification Search
CPC .. E21B 41/0035; E21B 41/0042; E21B 43/26; E21B 23/02; E21B 33/12
See application file for complete search history.

(56) References Cited

U.S. PATENT DOCUMENTS 5,564,503 A 10/1996 Longbottom et al.
5,697,445 A 12/1997 Gramham
(Continued)

OTHER PUBLICATIONS

Korean Intellectual Property Office, PCT/US2016/057411, International Search Report and Written Opinion, dated Jan. 10, 2017, 17 pages, Korea.
(Continued)

*Primary Examiner* — James G Sayre

(57) ABSTRACT

Systems and methods for stimulating wells include a frac window system positioned in a first wellbore adjacent a secondary wellbore extending from the first wellbore so that an opening in the frac window system aligns with a window in the first wellbore casing. The frac window system includes an elongated tubular with annular seals along the outer surface above and below the opening in the elongated tubular, and further includes an orientation device carried within the tubular. A main bore isolation sleeve is positioned within the frac window system to seal the opening, isolating the secondary wellbore from pressurized fluid directed farther down the first wellbore. A whipstock seats on the orientation device so that a surface of the whipstock is aligned with the secondary wellbore window of the first wellbore casing. The whipstock guides a straddle stimulation tool into the secondary wellbore from the first wellbore.

16 Claims, 13 Drawing Sheets

(51) Int. Cl.
*E21B 33/12* (2006.01)
*E21B 23/02* (2006.01)

(56) References Cited

U.S. PATENT DOCUMENTS

| | | | | |
|---|---|---|---|---|
| 5,715,891 | A | 2/1998 | Graham | |
| 5,730,224 | A | 3/1998 | Williamson et al. | |
| 5,735,350 | A | 4/1998 | Longbottom et al. | |
| 5,964,287 | A | 10/1999 | Brooks | |
| 5,975,208 | A | 11/1999 | Brooks | |
| 5,992,524 | A | 11/1999 | Graham | |
| 5,992,525 | A | 11/1999 | Williamson et al. | |
| 6,009,949 | A * | 1/2000 | Gano | E21B 41/0042 166/117.6 |
| 6,012,537 | A | 1/2000 | Rountree et al. | |
| 6,029,747 | A | 2/2000 | Morrell et al. | |
| 6,035,937 | A | 3/2000 | Gano et al. | |
| 6,053,254 | A | 4/2000 | Gano | |
| 6,062,306 | A | 5/2000 | Gano et al. | |
| 6,065,543 | A | 5/2000 | Gano et al. | |
| 6,092,593 | A | 7/2000 | Williamson et al. | |
| 6,092,602 | A | 7/2000 | Gano | |
| 6,119,771 | A | 9/2000 | Gano et al. | |
| 6,158,514 | A | 12/2000 | Gano et al. | |
| 6,209,648 | B1 | 4/2001 | Ohmer et al. | |
| 6,244,340 | B1 | 6/2001 | McGlothen et al. | |
| 6,439,312 | B1 | 8/2002 | Hess et al. | |
| 6,668,932 | B2 | 12/2003 | Hess et al. | |
| 6,679,829 | B2 | 1/2004 | Nigroni et al. | |
| 6,712,148 | B2 | 3/2004 | Fipke et al. | |
| 6,808,022 | B2 | 10/2004 | Smith | |
| 6,907,930 | B2 * | 6/2005 | Cavender | E21B 41/0042 166/242.3 |
| 6,907,935 | B2 | 6/2005 | Smith | |
| 6,930,806 | B2 | 8/2005 | Han et al. | |
| 6,935,428 | B2 | 8/2005 | McGlothen et al. | |
| 7,000,704 | B2 | 2/2006 | Smith | |
| 8,316,937 | B2 | 11/2012 | Cronley et al. | |
| 8,459,345 | B2 | 6/2013 | Bell | |
| 8,678,097 | B1 | 3/2014 | Telfer et al. | |
| 8,701,770 | B2 * | 4/2014 | Schultz | E21B 36/02 166/272.7 |
| 8,813,840 | B2 | 8/2014 | Zupanick | |
| 9,140,081 | B2 | 9/2015 | Telfer et al. | |
| 2002/0100588 | A1 * | 8/2002 | Murray | E21B 41/0042 166/313 |
| 2002/0108754 | A1 * | 8/2002 | Hess | E21B 41/0035 166/313 |
| 2003/0221834 | A1 * | 12/2003 | Hess | E21B 41/0035 166/313 |
| 2011/0186291 | A1 | 8/2011 | Lang et al. | |
| 2012/0241144 | A1 | 9/2012 | Bell | |
| 2013/0068453 | A1 | 3/2013 | Al-Ajaji et al. | |
| 2013/0327572 | A1 * | 12/2013 | Sponchia | E21B 41/0035 175/61 |
| 2014/0034298 | A1 | 2/2014 | Donovan | |
| 2014/0124198 | A1 | 5/2014 | Donovan | |

OTHER PUBLICATIONS

12MLTZZ0185, Drawings, Halliburton, Isorite Window With Hydraulic-Actuated TEW.SLDASM Reference 12X91159.SLDPRT.

* cited by examiner

JUNCTION ISOLATION TOOL FOR FRACKING OF WELLS WITH MULTIPLE LATERALS

CROSS-REFERENCE TO RELATED APPLICATIONS

This application is a U.S. National Stage patent application of International Patent Application No. PCT/US2016/057411, filed on Oct. 17, 2016, which claims priority to U.S. Provisional Application No. 62/246,473, filed on Oct. 26, 2015, entitled "Junction Isolation Tool for Fracking of Wells with Multiple Laterals," the disclosure of which is hereby incorporated by reference in its entirety.

BACKGROUND

In the production of hydrocarbons, it is common to drill one or more secondary wellbores from a first wellbore. Typically, the first and secondary wellbores, collectively referred to as a multilateral wellbore, will be drilled, cased and perforated using a drilling rig. Thereafter, once completed, the drilling rig will be removed and the wellbores will produce hydrocarbons.

During any stage of the life of a wellbore, various treatment fluids may be used to stimulate the wellbore. As used herein, the term "treatment," or "treating," refers to any subterranean operation that uses a fluid in conjunction with a desired function and/or for a desired purpose. The term "treatment," or "treating," does not imply any particular action by the fluid or any particular component of the fluid.

One common stimulation operation that employs a treatment fluid is hydraulic fracturing. Hydraulic fracturing operations generally involve pumping a treatment fluid (e.g., a fracturing fluid) into a wellbore that penetrates a subterranean formation at a sufficient hydraulic pressure to create one or more cracks, or "fractures," in the subterranean formation through which hydrocarbons will flow more freely. In some cases, hydraulic fracturing can be used to enhance one or more existing fractures. "Enhancing" one or more fractures in a subterranean formation, as that term is used herein, is defined to include the extension or enlargement of one or more natural or previously created fractures in the subterranean formation. "Enhancing" may also include positioning material (e.g. proppant) in the fractures to support ("prop") them open after the hydraulic fracturing pressure has been decreased (or removed).

During the initial production life of a wellbore—often called the primary phase—primary production of hydrocarbons typically occurs either under natural pressure, or by means of pumps that are deployed within the wellbore. This may include wellbores that have undergone stimulation operations, such a hydraulic fracturing, during a completion process. Unconventional wells typically will not produce economical amounts oil or gas unless they are stimulated via a hydraulic fracturing process to enhance and connect existing fractures. In order to reduce well costs, the hydraulic fracturing process is performed after the drilling rig has been removed from the well. Furthermore, wells may be hydraulically fractured without the aid of a workover rig if the equipment used to fracture a well is light enough to be transported in and out of the wellbore via a coiled tubing unit, wireline, electric line or other device.

Over the life of a wellbore, the natural driving pressure will decrease to a point where the natural pressure is insufficient to drive the hydrocarbons to the surface given the natural permeability and fluid conductivity of the formation. At this point, the reservoir permeability and/or pressure must be enhanced by external means. In secondary recovery, treatment fluids are injected into the reservoir to supplement the natural permeability. Such treatment fluids may include water, natural gas, air, carbon dioxide or other gas and a proppant to hold the fractures open.

Likewise, in addition to enhancing the natural permeability of the reservoir, it is also common through tertiary recovery, to increase the mobility of the hydrocarbons themselves in order to enhance extraction, again through the use of treatment fluids. Such methods may include steam injection, surfactant injection and carbon dioxide flooding.

In both secondary and tertiary recovery, hydraulic fracturing may also be used to enhance production.

Depending on the nature of the secondary or tertiary operation, it may be necessary to redeploy a rig, often referred to as a "workover rig," to the wellbore to assist in these operations, which may require additional equipment be installed in a wellbore. For example, subjecting a producing wellbore to hydraulic fracturing pressures after it has been producing may damage certain casings, installations or equipment already in a wellbore. Thus, it may be necessary to install additional equipment to protect the various equipment and tools already in the wellbore before proceeding with such operations. Such additional equipment is typically of sufficient size and weight that requires the use of a workover rig. As the number of secondary wellbores in a multilateral wellbore increases, the difficulty in protecting the various equipment in the first wellbore and the secondary wellbores becomes even more pronounced.

It would be desirable to provide a system that avoids the need for drilling or workover rigs in treatment fluid operations in multilateral wellbores, particularly those subject to stimulation techniques such as hydraulic fracturing.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION OF THE INVENTION

Figure 1:
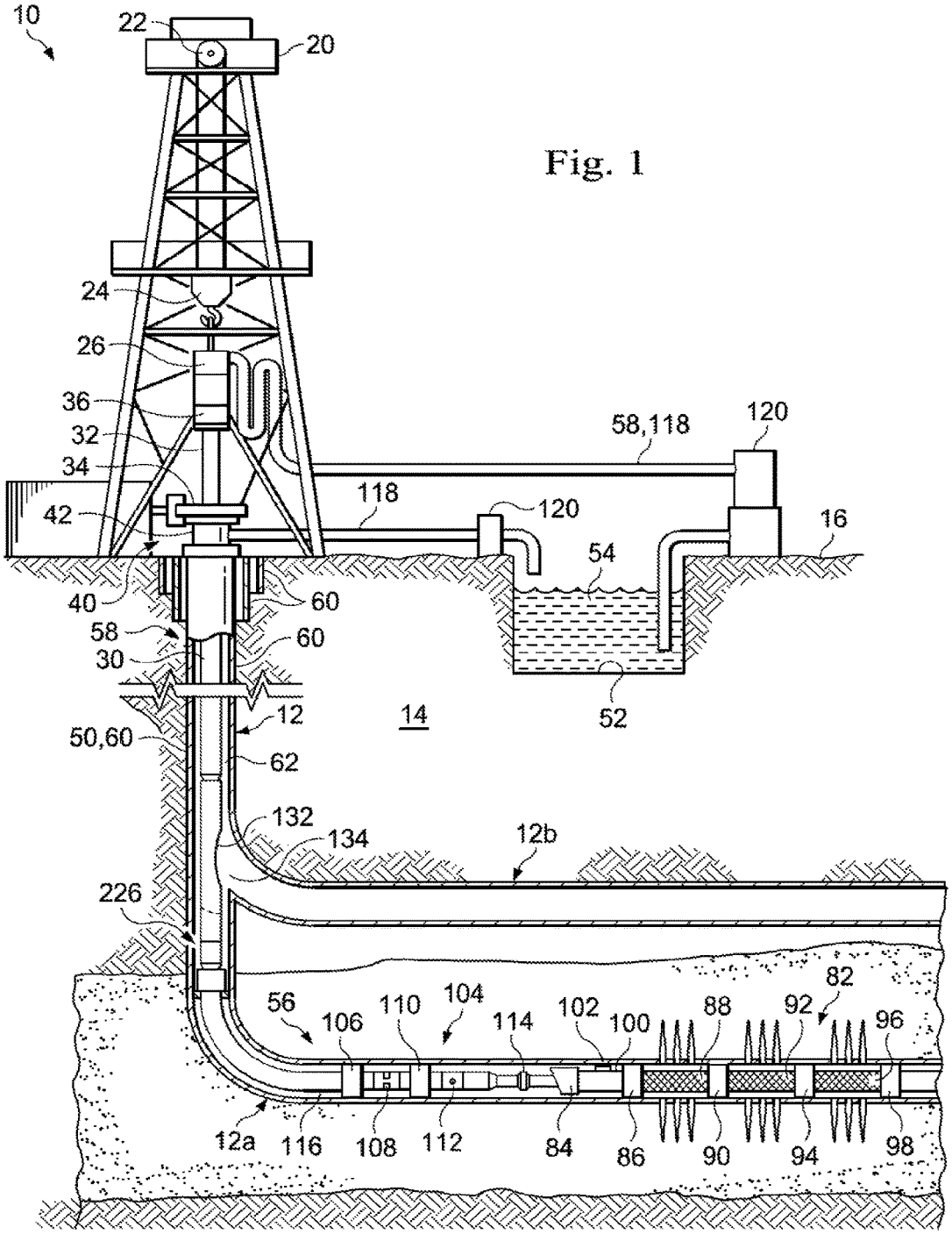
FIG. 1 is a partially cross-sectional side view of an embodiment of a frac window system of the disclosure illustrated as deployed in a land-based drilling and production system.

The disclosure may repeat reference numerals and/or letters in the various examples or Figures. This repetition is for the purpose of simplicity and clarity and does not in itself dictate a relationship between the various embodiments and/or configurations discussed. Further, spatially relative terms, such as beneath, below, lower, above, upper, uphole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the uphole direction being toward the surface of the wellbore, the downhole direction being toward the toe of the wellbore. Unless otherwise stated, the spatially relative terms are intended to encompass different orientations of the apparatus in use or operation in addition to the orientation depicted in the Figures. For example, if an apparatus in the Figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover even though a Figure may depict a horizontal wellbore or a vertical wellbore, unless indicated otherwise, it should be understood by those skilled in the art that the apparatus according to the present disclosure is equally well suited for use in wellbores having other orientations including vertical wellbores, deviated wellbores, multilateral wellbores or the like. Likewise, unless otherwise noted, even though a Figure may depict an offshore operation, it should be understood by those skilled in the at that the apparatus according to the present disclosure is equally well suited for use in onshore operations and vice-versa. Further, unless otherwise noted, even though a Figure may depict a cased hole, it should be understood by those skilled in the art that the apparatus according to the present disclosure is equally well suited for use in open hole operations.

As used herein, "first wellbore" shall mean a wellbore from which another wellbore extends (or is desired to be drilled, as the case may be). Likewise, a "second" or "secondary" wellbore shall mean a wellbore extending from another wellbore. The first wellbore may be a primary, main or parent wellbore, in which case, the secondary wellbore is a lateral or branch wellbore. In other instances, the first wellbore may be a lateral or branch wellbore, in which case the secondary wellbore is a "twig" or a "tertiary" wellbore.

Generally, in one or more embodiments, a frac window system is provided in a multilateral wellbore with a secondary wellbore extending from a first wellbore. The frac window system includes a tubular having an opening therein that aligns with a secondary wellbore window formed in the casing string of the first wellbore. The frac window system includes annular seals along the outer surface of the tubular above and below the opening, and further includes an orientation device carried within the tubular. In one or more embodiments, a main bore isolation sleeve is positioned within the frac window system to seal the opening in the frac window system and the secondary wellbore window in the first wellbore casing to isolate the secondary wellbore from high pressure fluid directed farther down the first wellbore casing. In one or more embodiments, a whipstock seats on the orientation device so that a surface of the whipstock is aligned with the secondary wellbore window of the first wellbore casing string. In one or more embodiments, a straddle stimulation tool abuts the surface of the whipstock and extends through the frac window system opening from the first wellbore into the secondary wellbore.

Figure 2:
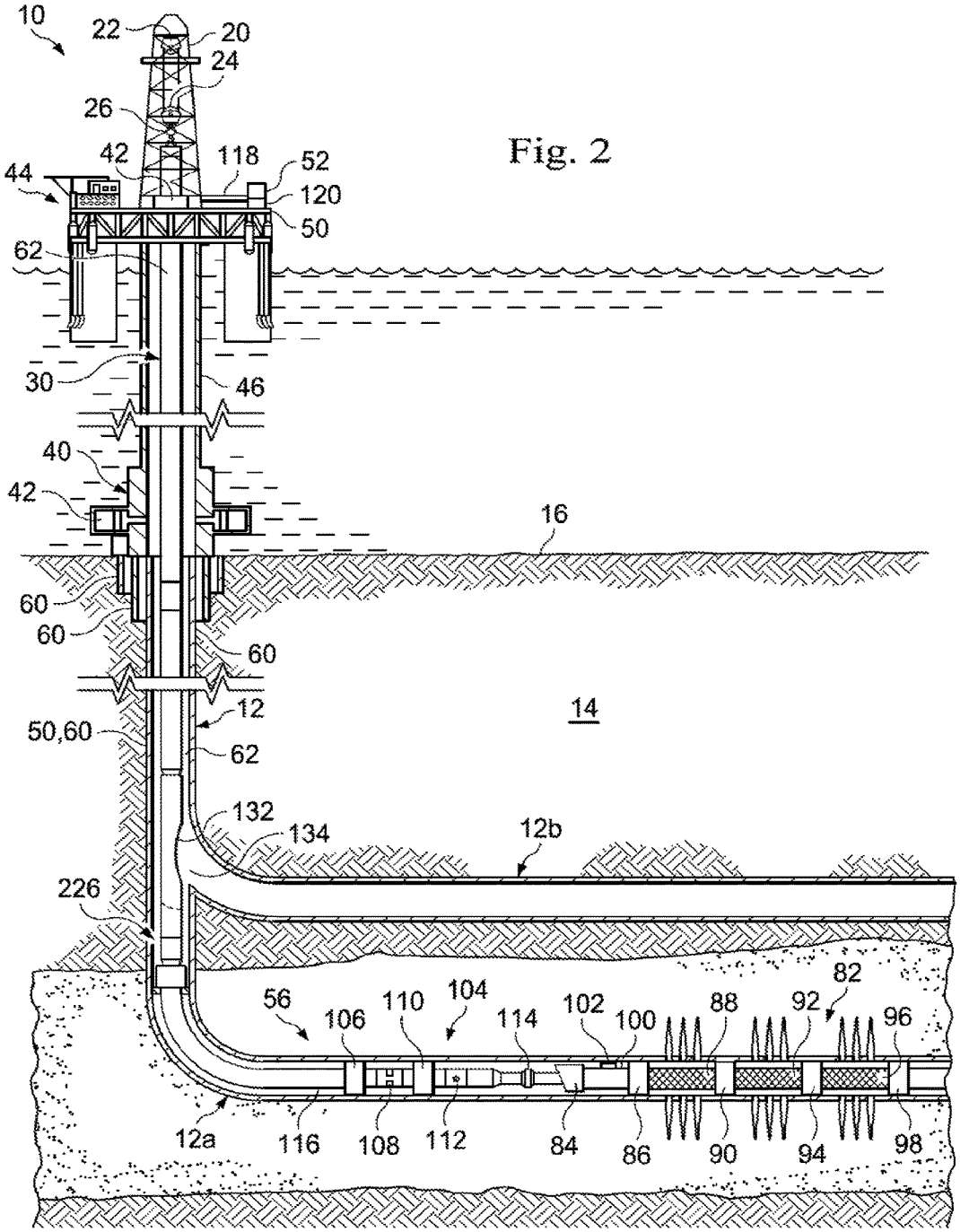
FIG. 2 is a partially cross-sectional side view of an embodiment of a frac window system of the disclosure illustrated as deployed in a marine-based production system.

Turning to FIGS. 1 and 2, shown is an elevation view in partial cross-section is a frac window system 226 deployed in a wellbore drilling and production system 10 (land based in FIG. 1 and offshore in FIG. 2) utilized to produce hydrocarbons from wellbore 12 extending through various earth strata in a petroleum formation 14 located below the earth's surface 16. Wellbore 12 may be formed of a single first wellbore and may include one or more second or secondary wellbores 12*a*, 12*b* . . . 12*n*, extending into the formation 14, and disposed in any orientation and spacing, such as the horizontal secondary wellbores 12*a*, 12*b* illustrated.

Drilling and production system 10 includes a drilling rig or derrick 20. Drilling rig 20 may include a hoisting apparatus 22, a travel block 24, and a swivel 26 for raising and lowering a conveyance vehicle such as tubing string 30. Other types of conveyance vehicles may include tubulars such as casing, drill pipe, coiled tubing, production tubing, other types of pipe or tubing strings. Still other types of conveyance vehicles may include wirelines, slicklines, and the like. In FIG. 1, tubular string 30 is a substantially tubular, axially extending work string formed of a plurality of drill pipe joints coupled together end-to-end, while in FIG. 2, tubing string 30 is completion tubing supporting a completion assembly as described below. Drilling rig 12 may include a kelly 32, a rotary table 34, and other equipment associated with rotation and/or translation of tubing string 30 within a wellbore 12. For some applications, drilling rig 18 may also include a top drive unit 36.

Drilling rig 20 may be located proximate to a wellhead 40 as shown in FIG. 1, or spaced apart from wellhead 40, such as in the case of an offshore arrangement as shown in FIG. 2. One or more pressure control devices 42, such as blowout preventers (BOPs) and other equipment associated with drilling or producing a wellbore may also be provided at wellhead 40 or elsewhere in the wellbore drilling and production system 10.

For offshore operations, as shown in FIG. 2, whether drilling or production, drilling rig 20 may be mounted on an oil or gas platform, such as the offshore platform 44 as illustrated, or on semi-submersibles, drill ships, and the like (not shown). Wellbore drilling and production system 10 of FIG. 2 is illustrated as being a marine-based production system. Likewise, wellbore drilling and production system 10 of FIG. 1 is illustrated as being a land-based production system. In any event, for marine-based systems, one or more subsea conduits or risers 46 extend from deck 50 of platform 44 to a subsea wellhead 40. Tubing string 30 extends down from drilling rig 20, through riser 46 and BOP 42 into wellbore 12.

A fluid source 52, such as a storage tank or vessel, may supply a working or service fluid 54 pumped to the upper end of tubing string 30 and flow through tubing string 30. Fluid source 52 may supply any fluid utilized in wellbore operations, including without limitation, drilling fluid, cementious slurry, acidizing fluid, liquid water, steam, hydraulic fracturing fluid or some other type of fluid.

Wellbore 12 may include subsurface equipment 56 disposed therein, such as, for example, the completion equipment illustrated in FIG. 1 or 2. In other embodiments, the subsurface equipment 56 may include a drill bit and bottom hole assembly (BHA), a work string with tools carried on the work string, a completion string and completion equipment or some other type of wellbore tool or equipment.

Wellbore drilling and production system 10 may generally be characterized as having a pipe system 58. For purposes of this disclosure, pipe system 58 may include casing, risers, tubing, drill strings, completion or production strings, subs, heads or any other pipes, tubes or equipment that attaches to the foregoing, such as tubing string 30 and riser 46, as well as the wellbore and laterals in which the pipes, casing and strings may be deployed. In this regard, pipe system 58 may include one or more casing strings 60 that may be cemented in wellbore 12, such as the surface, intermediate and production casing strings 60 shown in FIG. 1. An annulus 62 is formed between the walls of sets of adjacent tubular components, such as concentric casing strings 60 or the exterior of tubing string 30 and the inside wall of wellbore 12 or casing string 60, as the case may be.

As shown in FIGS. 1 and 2, where subsurface equipment 56 is illustrated as completion equipment, disposed in secondary wellbore 12*a* is a lower completion assembly 82 that includes various tools such as an orientation and alignment subassembly 84, a packer 86, a sand control screen assembly 88, a packer 90, a sand control screen assembly 92, a packer 94, a sand control screen assembly 96 and a packer 98.

Extending uphole and downhole from lower completion assembly 82 is one or more communication cables 100, such as a sensor or electric cable, that passes through packers 86, 90 and 94 and is operably associated with one or more electrical devices 102 associated with lower completion assembly 82, such as sensors positioned adjacent sand control screen assemblies 88, 92, 96 or at the sand face of formation 14, or downhole controllers or actuators used to operate downhole tools or fluid flow control devices. Cable 100 may operate as communication media, to transmit power, or data and the like between lower completion assembly 82 and an upper completion assembly 104.

In this regard, disposed in wellbore 12, the upper completion assembly 104 is coupled at the lower end of tubing string 30. The upper completion assembly 104 includes various tools such as a packer 106, an expansion joint 108, a packer 110, a fluid flow control module 112 and an anchor assembly 114.

Extending uphole from upper completion assembly 104 are one or more communication cables 116, such as a sensor cable or an electric cable, which passes through packers 106, 110 and extends to the surface 16. Cable(s) 116 may operate as communication media, to transmit power, or data and the like between a surface controller (not pictured) and the upper and lower completion assemblies 104, 82.

Fluids, cuttings and other debris returning to surface 16 from wellbore 12 may be directed by a flow line 118 back to storage tanks, fluid source 52 and/or processing systems 120, such as shakers, centrifuges and the like.

In each of FIGS. 1 and 2, a frac window system 226 is generally illustrated. Frac window system 226 is positioned adjacent secondary wellbore 12*b* so that an opening 132 in the frac window system 226 is aligned with the casing window 134 of casing string 60 adjacent secondary wellbore 12*b*.

Figure 3:
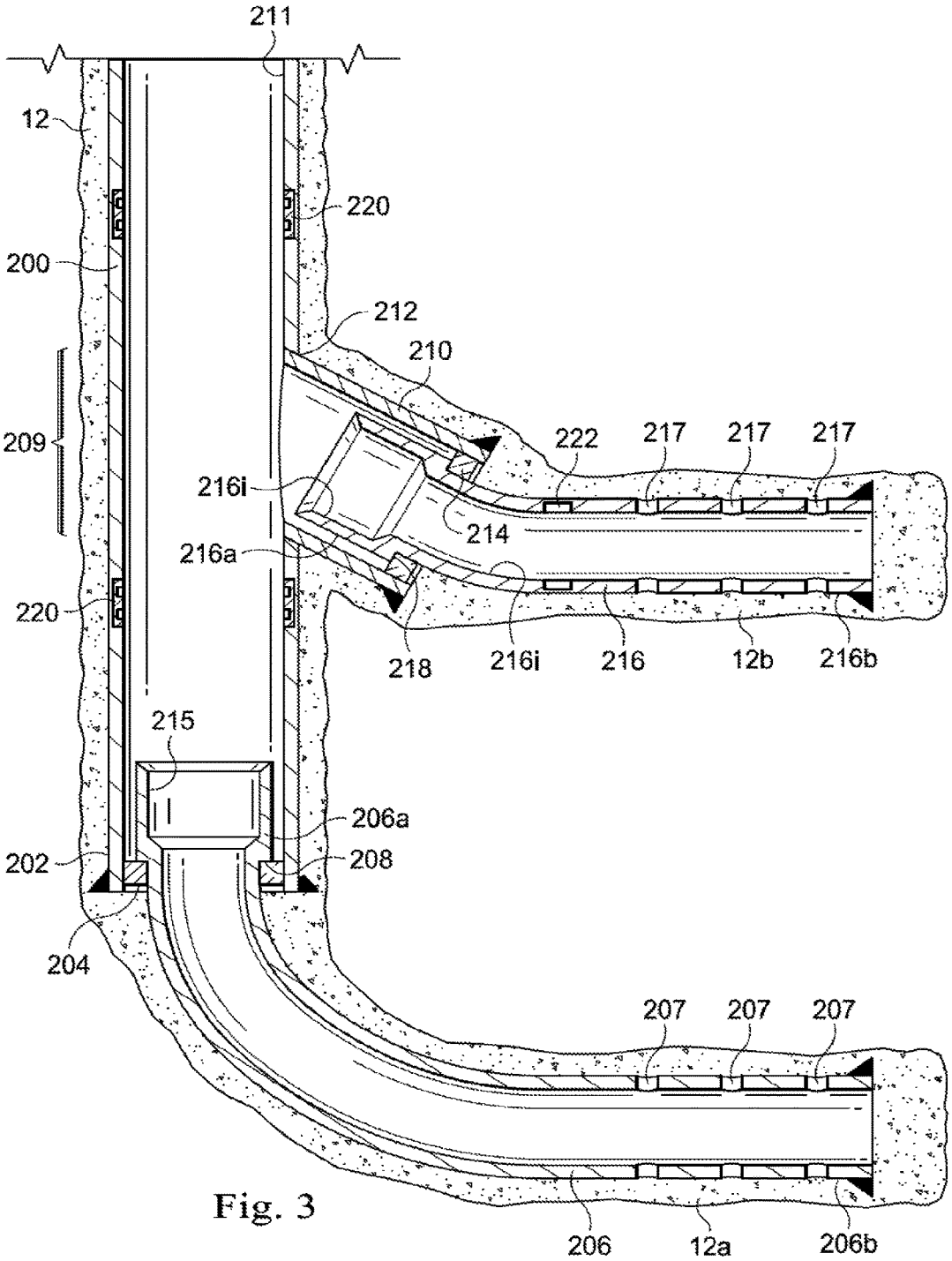
FIG. 3 is an elevation view in cross-section of a first wellbore and upper and lower secondary wellbores of the disclosure.

FIG. 3 is an elevation view in cross-section of the first wellbore 12 and the upper and lower secondary wellbores, 12*b* and 12*a*, respectively, illustrated as extending from first wellbore 12 in more detail. Specifically, the first wellbore 12 is illustrated as being at least partially cased with a first wellbore casing 200 cemented therein. While generally illustrated as vertical, first wellbore 12, as well as any of the wellbores described, may have any orientation. In any event, at the distal end 202 of first wellbore 12, a casing hanger 204 may be deployed from which a secondary wellbore casing 206 hangs. Secondary wellbore casing 206 has a proximal end 206*a* and a distal end 206*b*. The proximal end 206*a* may include a shoulder 208 for supporting secondary wellbore casing 206 on hanger 204. The distal end 206*b* may include perforations 207 or sliding sleeves. Secondary wellbore casing 206 is illustrated as cemented in place within wellbore 12*a*. Proximal end 206*a* may also include a polished bore receptacle (PBR) 215, which may be positioned above liner hanger 204. PBR 215 may have a larger inner diameter than the secondary wellbore casing 206. This prevents a seal 242 (see FIG. 4) from creating a restriction smaller than the casing 206 inner diameter.

Likewise, with regard to secondary wellbore 12*b*, which is formed at a junction 209 with first wellbore 12, a transition joint 210 extends from a casing window 212 formed along the inner annulus 211 of casing 200. Transition joint 210 may be made of steel, fiberglass or any material capable of supporting itself under the pressure of fluids, cement or solid objects such as rock in a downhole environment. A casing hanger 214 may be deployed from which a secondary wellbore casing 216 hangs. Secondary wellbore casing 216 has a proximal end 216*a* and a distal end 216*b* and an interior surface 216*i*. The distal end 216*b* may include perforations 217. The proximal end 216*a* may include a shoulder 218 for supporting casing 216 on hanger 214. Secondary wellbore casing 216 is illustrated as cemented in place within wellbore 12*b*. In other embodiments (not shown) the transition joint 210 may be threaded directly to a PBR, which in turn is threaded to the secondary wellbore casing 216, and no casing hanger 214 is necessary.

Persons of ordinary skill in the art will appreciate that the illustrated first wellbore 12 and secondary wellbores 12*a*, 12*b*, and the equipment illustrated therein, are for illustrative purposes only, and are not intended to be limiting. For example, secondary wellbore casing strings 206, 216 are not limited to a particular size or manner of support, and other systems for supporting secondary wellbore casing may be utilized.

Any one or more of the casing strings or tubulars described herein may include an engagement mechanism 220 deployed along an inner surface and disposed to engage a cooperating engagement mechanism, such as engagement mechanism 246 (FIG. 4) described below, to secure or otherwise anchor adjacent tubulars relative to one another at a desired depth and/or orientation. In one or more embodiments, engagement mechanism 220 may be latch couplings as are shown deployed along first wellbore casing 200. In one or more embodiments, an engagement mechanism 220 is positioned adjacent to window 212 at a known distance. In one or more embodiments, an engagement mechanism 220 is positioned adjacent window 212 upstream or above junction 209, while in other embodiments, the engagement mechanism is positioned adjacent window 212 downstream or below junction 209. The disclosure is not limited to a particular type of engagement mechanism 220.

Similar to engagement mechanism 220, an engagement mechanism 222 is illustrated along the interior surface 216*i* of casing 216.

Figure 4:
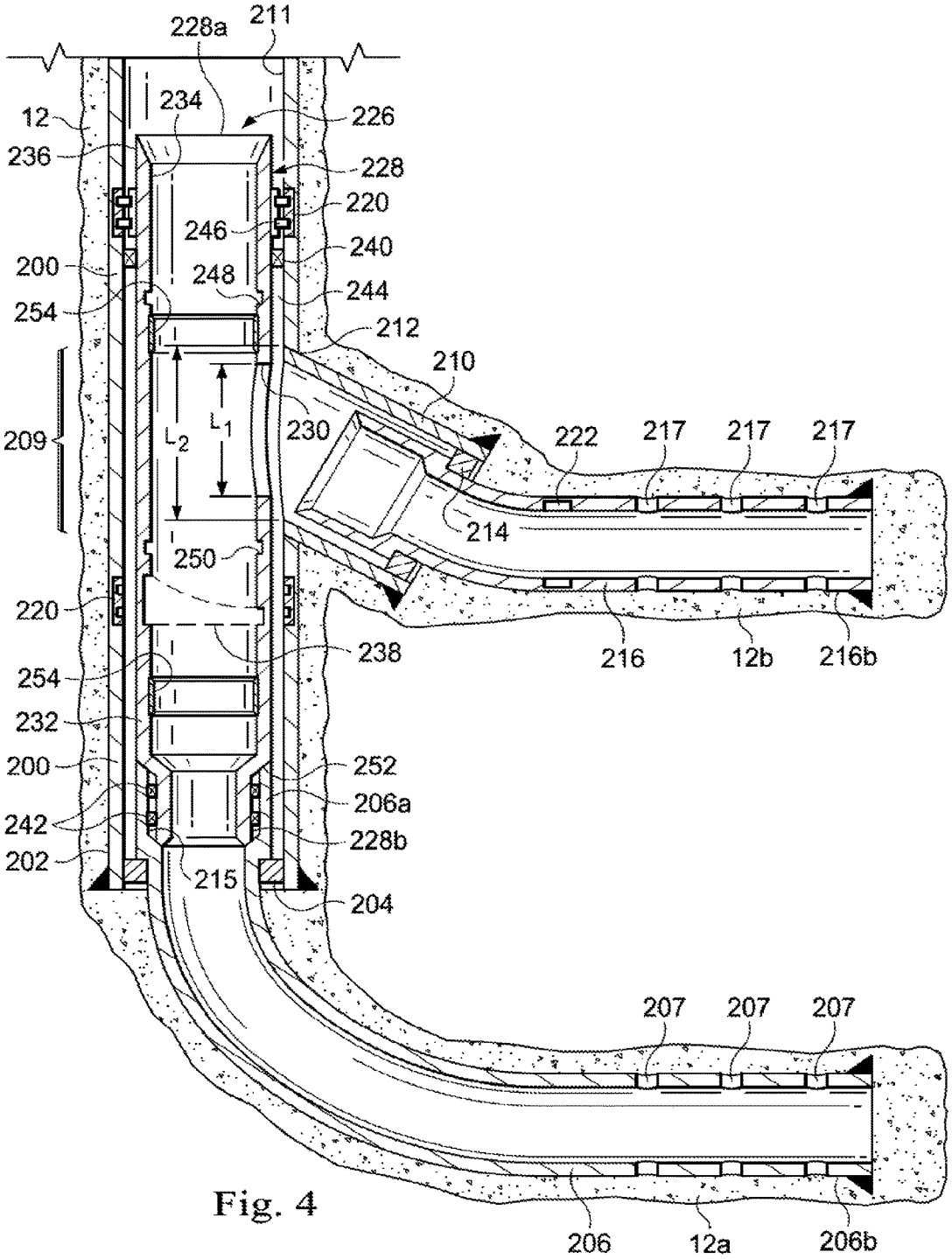
FIG. 4 is an elevation view in cross section of a frac window system deployed in the wellbores of FIG. 3.

Turning to FIG. 4, an elevation view in cross section illustrates the frac window system 226 deployed adjacent junction 209 within first wellbore casing 200. Frac window system 226 is formed of an elongated tubular 228 having a first end 228*a* and a second end 228*b* with an opening 230 defined in a wall 232 of the tubular between ends 228*a*, 228*b*. The elongated tubular 228 may extend a significant distance, and may be constructed of multiple casing, tubing or other pipe without departing from the scope and spirit of the disclosure. Elongated tubular 228 includes an inner surface 234 and an outer surface 236.

An orientation device 238 is disposed or otherwise formed along the inner surface 234 of elongated tubular 228. In one or more embodiments, orientation device 238 is located below the opening 230, between opening the 230 and the second end 228*b* of elongated tubular 228. Although orientation device 238 may be any mechanism or device that permits radial orientation of a tool or equipment within elongated tubular 228, in one or more embodiments, orientation device 238 may be a scoop head, a muleshoe or a ramped or angled surface.

Frac window system 226 further includes a first seal 240 disposed along the outer surface 236 of the elongated tubular 228. In one or more embodiments, first seal 240 is disposed along the outer surface 236 between the opening 230 and the first end 228*a* of the elongated tubular 228. Likewise, a second seal 242 is disposed along the outer surface 236 below opening 230 between opening 230 and the second end 228*b* of elongated tubular 228. First seal 240 extends between frac window 226 and casing 200 to seal the annular space 244 therebetween. Likewise, second seal 242 extends between the outer surface 236 of the elongated tubular 228 and an inner surface of the adjacent tubular, e.g., first wellbore casing 200, to seal the annular space about the second end 228*b* of elongated tubular 228. In the illustrated embodiment, second end 228*b* extends into proximal end 206*a* of secondary wellbore casing 206, and in such case, second seal 242 seals the annular space therebetween. In other embodiments, second seal 242 may be disposed along the end of 228*b* of elongated tubular 228 to seal between frac window system 226 and the first wellbore casing 200, and in particular, in some embodiments, PBR 215. In other embodiments, second seal 242 may be disposed along the inner surface 234 of the elongated tubular 228 at the second end of 228*b* to seal between frac window system 226 and a tubular (not shown) extending therein.

Seals 240, 242 as described may be any mechanism that can seal an annular space between tubulars, such as for example an expandable liner hanger system, swellable elastomer or otherwise, any type of, or combination of, elastomeric element(s) or composite elements made of man-made and/or natural materials that may be deployed to effectuate a sealing contact with both tubulars as described. A seal may include a shoulder, such as shoulder 252 formed along the outer surface 236 of elongated tubular 228. The elongated tubular 228 may include a plurality of joints of pipe spanning the distance between the shoulder 252 and smooth sealing surfaces 254 may also be provided along the inner surface 234 of the elongated tubular 228. The shoulder 252 may engage a similarly formed shoulder, such as the end of secondary wellbore casing 206, against which shoulder 252 may seat, forming a metal-to-metal seal. In one or more embodiments, shoulder 252 may consist of one or more of the following metals or alloys, 316 Stainless, C-276 alloy, 718 alloy, brass, and/or bronze, etc. Although not limited to a particular configuration, the most common place shoulder 252 would engage is in the PBR 215 attached to hanger 204. This would typically be an "anchor" type of mechanism wherein shoulder 252 would have a releasable anchoring device such as a latch, a lug, a snap or similar mechanism, to attach itself to the top of the PBR 215 or to the top of hanger 204. The top of PBR 215 or the top of hanger 204 may include a receiving head, a lug-receiver, a snap locator or other device to receive, releasably secure, and/or provide a sealing surface for shoulder 252, and/or seal 242 and/or end 228*b* of elongated tubular 228. The disclosure is not limited to a particular type of mechanism that can seal an annular space between tubulars.

In other embodiments, shoulder 252 may be disposed along the inner surface 234 of end of 228*b* of elongated tubular 228 to engage a similarly formed shoulder, such as the end of secondary wellbore casing 206.

Frac window system 226 may further include an engagement mechanism 246 along outer surface 236 and disposed for engagement with an engagement mechanism 220. In one or more embodiments, engagement mechanism 246 is a latch and engagement mechanism 220 is a latch coupling.

In one or more embodiments, engagement mechanism 246 may be an Engagement. Orientation, and Depth (EMOD) device that provides depth, orientation and an engagement into an accepting device. The engagement device of the EMOD may be one that is releasable. The EMOD may provide depth, orientation and releasable engagement in concert with a device such as engagement mechanism 220 or engagement mechanism 222 or against a surface of a pipe or other device having a generally circular form and an inner and outer surface. In further embodiments, engagement mechanism 246 may be a collet. In other embodiments, engagement mechanism 246 may be a multiplicity of collets, keys, slips, latches, etc. Engagement mechanism 246 may also consist of multiple devices to provide depth, orientation and/or engagement such as collets, keys, slips, and/or latches, etc. Thus, for example, the engagement mechanism 246 in the form of an EMOD may be mounted on the outer surface 236 of the elongated tubular 228 for engagement with an engagement mechanism 220, such as a latch coupling, disposed along the interior annulus of the first wellbore casing 200. In one or more embodiments, the engagement mechanism 220 of the casing 200 is above window 212, and the EMOD 246 of frac window system 226 is between the opening 230 and first end 228*a* of the tubular. In one or more embodiments, the EMOD 246 is between the first seal 240 and the first end 228*a* of the tubular. It will be appreciated that in one or more embodiments, engagement mechanism 246 may function to releasably engage another engagement mechanism, such as engagement mechanism 220 or 222; function as a no-go shoulder (depth lock or stop) at a desired depth; and provide an orientation lock at a desired orientation.

In any event, regardless of the particular type, in one or more embodiments, although engagement mechanism 246 may be disposed anywhere along the outer surface 236 so long as the axial position between frac window system 226 and window 212 is established, engagement mechanism 246 is disposed between the opening 230 and the first end 228*a* to engage an engagement mechanism 220 upstream of window 212, as illustrated. In one or more embodiments, the engagement mechanism 246 is between the first seal 240 and the first end 228*a* so that the engagement mechanism 246 may be isolated from pressurized fluid that may be introduced into one of the secondary wellbores 12*a*, 12*b*. In other embodiments, the latch 246 is between the second seal 242 and the second end 228*b*.

As will be appreciated, when engagement mechanism 246 is a latch and engagement mechanism 220 is a latch coupling, cooperation between the two mechanism 220, 246 can be utilized to both axially and radially position frac window system 226. However, in one or more embodiments, engagement mechanism 220 need not be present. Rather, engagement mechanism 246 may be another type of device or mechanism to secure and/or position frac window system 226 in wellbore 12. In one or more embodiments, engagement mechanism 246 may be an expandable liner hanger carried on the outer surface 236 of elongated tubular 228. Alternatively, or in addition, engagement mechanism 246 may be one or more slips that can be actuated to anchor against the first wellbore casing (or the wall of first wellbore 12 in the instance of an uncased wellbore). In one or more embodiments, engagement mechanism 246 may be one or more collets. In other embodiments, 246 may be a multiplicity of collets, keys, slips, latches, pockets, grooves, recesses, indentations, slots, splines, etc. Also, mechanism 220 may consist of multiple devices to provide depth, orientation and/or engagement such as collets, keys, slips, and/or latches, etc. The disclosure is not limited to a particular type of engagement mechanism. Alternatively, or in addition, in one or more embodiments, engagement mechanism 246 may be, or work in concert with, a mechanically, hydraulically, and/or electrically activated window finder deployed within elongated tubular 228 that will actuate and extend at least partially through opening 230 and window 212 when the opening 230 and casing window 212 are aligned. In such case, it will be appreciated, with the relative alignment achieved, another engagement mechanism, such as an expandable liner hanger or slips, may be actuated to anchor elongated tubular 228 in position.

It will be appreciated that latch 246 and latch coupling 220 permit frac window system 226 to be axially and radially oriented so that frac window system 226 is adjacent junction 209, and thus window 212, and that opening 230 is aligned with window 212 of casing 200.

Frac window system 226 may further include a first depth mechanism 248 disposed along the inner surface 234. In one or more embodiments, the first depth mechanism 248 is between the opening 230 and the first end 228*a* of elongated tubular 228. Similarly, a depth mechanism 250 may be disposed along the inner surface 234 adjacent the orientation device 238.

When deployed as described above, opening 230 of frac window system 226 is aligned with window 212 of casing 200 and the annulus about elongated tubular 228 is sealed above and below window 212. In one or more embodiments, opening 230 of frac window system 226 has a dimension $L_1$ that is smaller than the dimension $L_2$ of window 212.

One or more of the inner or outer surfaces of elongated tubular 228 adjacent the ends 228*a*, 228*b* may be threaded to assist in deployment of elongated tubular 228. For example, the inner surface 234 of elongated tubular 228 adjacent first end 228*a* may be threaded while the inner surface 234 adjacent second end 228*b*, as well as the outer surface 236 adjacent the two ends 228*a*, 228*b* may be smooth, the threads disposed to permit attachment of a running tool (not shown). However, in one or more embodiments, the inner and outer surfaces 234, 236 adjacent the ends 228*a*, 228*b* are all sufficiently smooth to permit an elastomeric element to seal against the surface. Thus, as used herein, "smooth" is used to refer to a surface that is not threaded. The smooth surface may have other shapes, features or contours, but is not otherwise disposed to engage the threads of another mechanism in order to join the mechanism to the surface. Other smooth sealing surfaces 254 may also be provided along the inner surface 234 of the elongated tubular 228 to ensure a desired level of sealing during operations employing frac window system 226.

Figure 5:
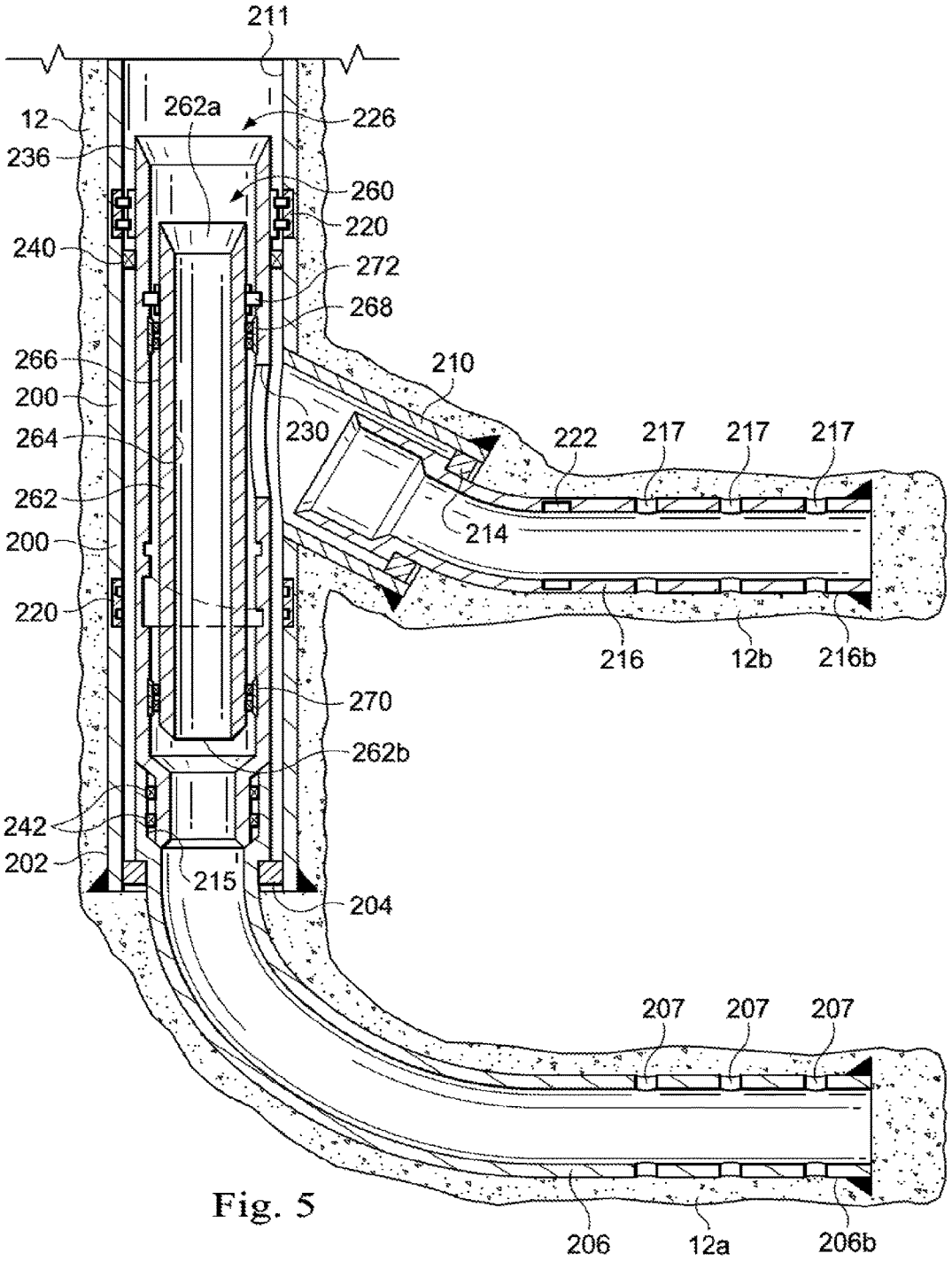
FIG. 5 is an elevation view in cross section of the frac window system of FIG. 4 illustrating a main bore isolation sleeve deployed within.

Turning to FIG. 5, the frac window system 226 is illustrated with a main bore isolation sleeve 260 deployed therein. Main bore isolation sleeve 260 if formed of a tubular sleeve 262 having a first end 262*a* and a second end 262*b*. Tubular sleeve 262 has an inner surface 264 and an outer surface 266.

Disposed along the outer surface 266 of tubular sleeve 262 are a first sleeve seal 268 and a second sleeve seal 270. First and second sleeve seals 268, 270 are spaced apart, as described below, to seal above and below opening 230 when main bore isolation sleeve 260 is deployed within frac window system 226.

Also disposed along the outer surface 266 of tubular sleeve 262 is a depth mechanism 272. In one or more embodiments, depth mechanism 272 is positioned between the first sleeve seal 268 and the first end 262*a*. Depth mechanism 272 is disposed to engage a depth mechanism disposed along the inner surface 234 of elongated tubular 228 of frac window system 226. In the illustrated embodiment, sleeve depth mechanism 272 engages first depth mechanism 248 of frac window system 226. When depth mechanism 272 is so engaged, the first end 262*a* of tubular sleeve 262 is above the opening 230 in the elongated tubular 228 and the second end 262*b* of tubular sleeve 262 is below the opening 230 in the elongated tubular 228 of frac window system 226. Moreover, when depth mechanism 272 is so engaged, the first sleeve seal 268 of tubular sleeve 262 is above the opening 230 in the elongated tubular 228 and the second sleeve seal 270 of tubular sleeve 262 is below the opening 230 in the elongated tubular 228 of frac window system 226, such that secondary wellbore 12*b* is isolated from first wellbore 12. In other words, fluid communication between secondary wellbore 12*b* and first wellbore 12 is blocked by main bore isolation sleeve 260, allowing various operations, such as high pressure pumping, in the first wellbore 12 or secondary wellbore 12*a* to occur without impacting secondary wellbore 12*b*.

Figure 6:
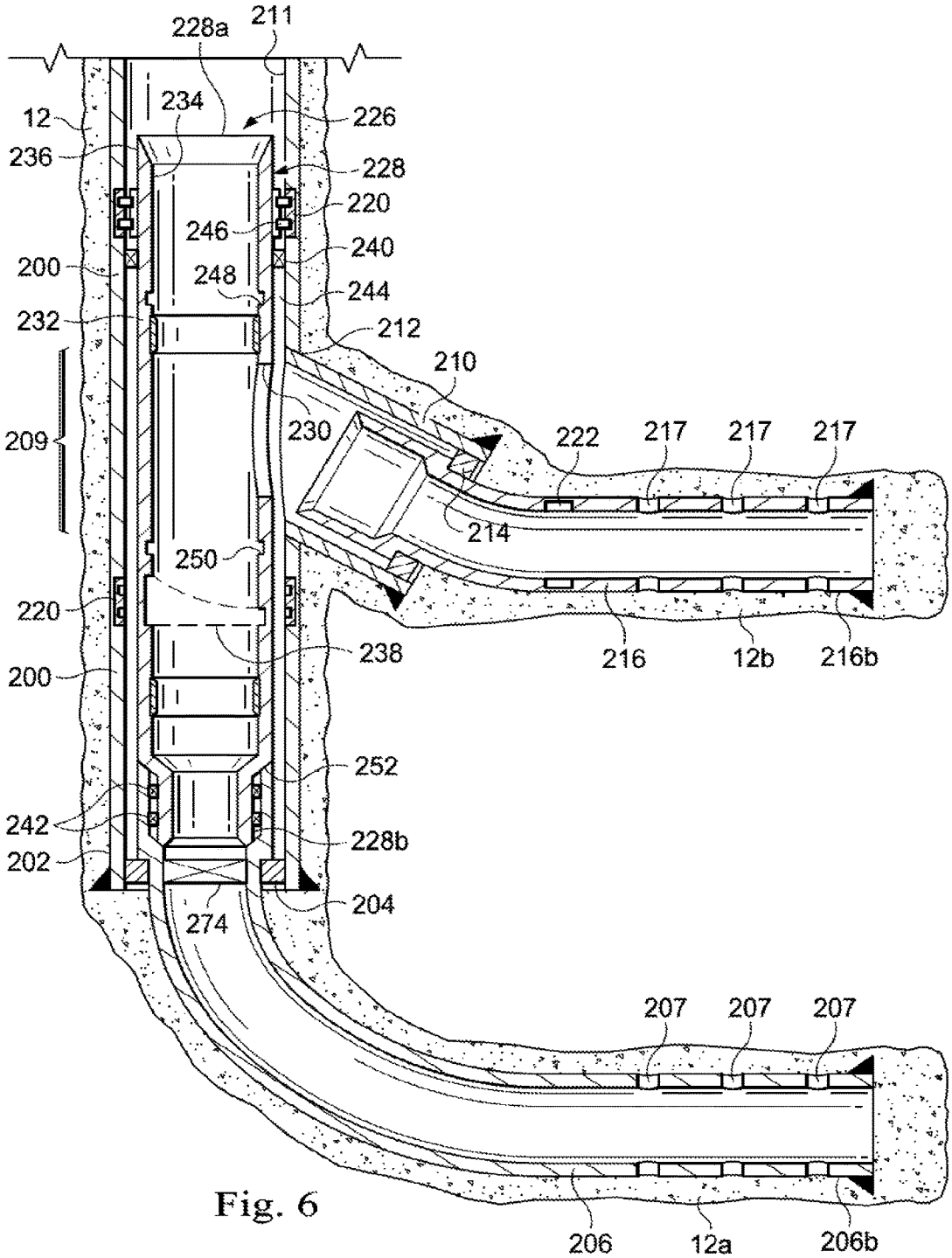
FIG. 6 is an elevation view in cross section of the frac window system of FIG. 4 illustrating a plug deployed in the lower secondary wellbore of FIG. 3.

Turning back to FIG. 4 and with reference to FIG. 6, the frac window system 226 is illustrated with a plug 274 deployed in the lower secondary wellbore 12*a*. Much in the same way that main bore isolation sleeve 260 is utilized to isolate secondary wellbore 12*b*, the plug 274 may be deployed to isolate secondary wellbore 12*a* from pumping operations relating to secondary wellbore 12*b*. Plug 274 may be set at any time. In some embodiments, plug 274 is set before running in frac window system 226, while in other embodiments, plug 274 may be set on the same run in trip as frac window system 226, while in other embodiments, plug 274 may be run in and set after frac window system 226 is in place. In this regard, plug 274 may be positioned within frac window system 226, preferably at a location adjacent end 228*b* or may be positioned in casing 206 of secondary wellbore 12*a* or within PBR 215 (FIG. 5), if present.

Figure 7:
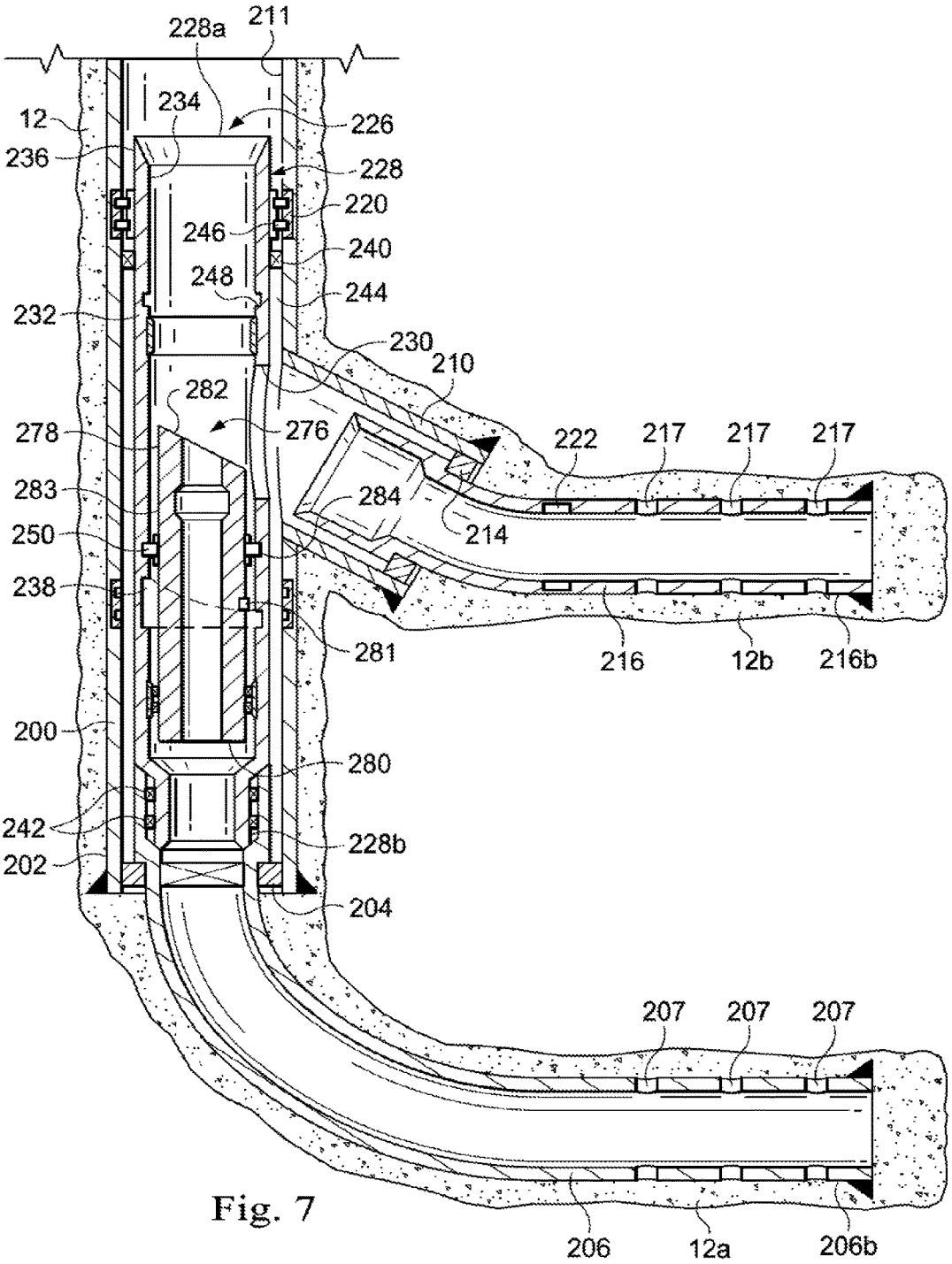
FIG. 7 is an elevation view in cross section of the frac window system of FIG. 4 illustrating a whipstock deployed in the frac window system.

In FIG. 7, a whipstock 276 is illustrated as deployed in frac window system 226. Whipstock 276 may be of any shape or configuration, but generally has first end 278 and a second end 280 with a contoured surface 282 at first end 278. Whipstock 276 may include a follower 281, such as a lug or similar device. Follower 281 is preferably positioned along the outer surface 283 of whipstock 276 and may protrude from the surface 283 to engage orientation device 238 of frac window system 226 in order to rotate whipstock 276 to the desired angular position within first wellbore 12. Likewise, whipstock 276 may include a depth mechanism 284 disposed to engage the mechanism 250 to secure the oriented whipstock 276 to elongated tubular 228 of frac window system 226. More specifically, when whipstock 276 is deployed within frac window system 226, whipstock 276 is axially positioned so that the first end 278 of whipstock 276 is adjacent opening 230 and radially positioned so that the contoured surface 282 will direct, deflect or otherwise guide tools and other devices passing down through first wellbore 12 through opening 230 and into secondary wellbore 12*b*.

It should be appreciated that as described herein, whipstock 276 is not limited to any particular type of whipstock, but may be any device which will deflect, direct or otherwise guide a tool or device through opening 230. In some embodiments, whipstock 276 may be a solid body, while in other embodiments, whipstock 276 may include an interior passage.

Figure 8:
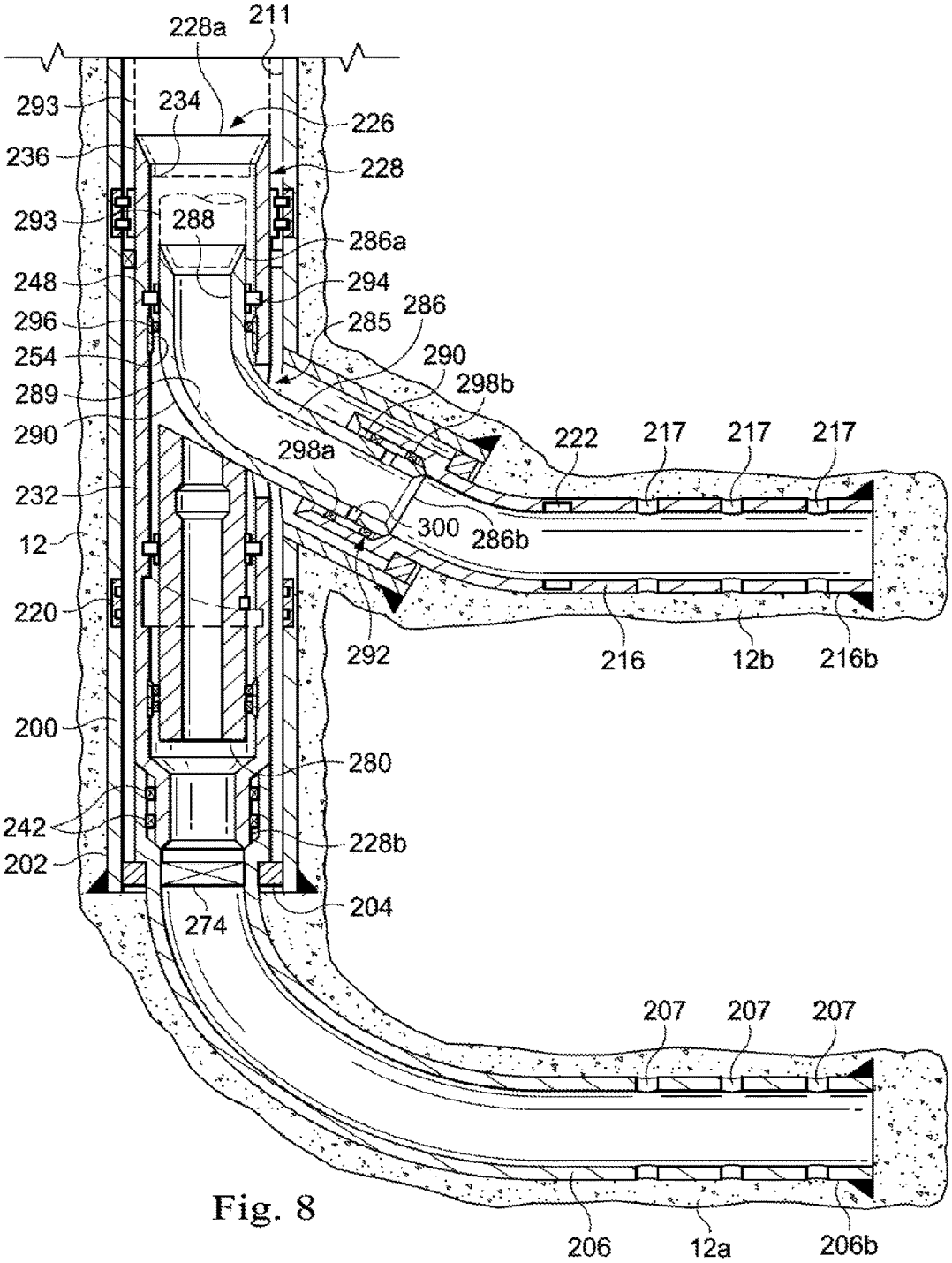
FIG. 8 is an elevation view in cross section of the frac window system of FIG. 4 illustrating a straddle stimulation tool ("SST") extending from the frac window system into the upper secondary wellbore of FIG. 3.

Turning to FIG. 8, a straddle stimulation tool 285 is illustrated extending from the frac window system 226 into the upper secondary wellbore 12*b*. Straddle stimulation tool 285 generally includes a straddle tubular 286 having a first end 286*a* and a second end 286*b* forming a flow bore 288 therebetween. Straddle tubular 286 includes an inner surface 289 and an outer surface 290. When deployed, straddle stimulation tool 285 is positioned so that first end 286*a* is in first wellbore 12 and second end 286*b* is in secondary wellbore 12*b*. In this regard, first end 286*a* may be positioned within elongated tubular 228 of frac window system 226 and second ends 286*b* may be positioned within the first end 216*a* of secondary wellbore casing 216.

More specifically, a first seal 292 may be disposed along the outer surface 290 adjacent the second end 286*b*. Seal 292 is disposed to engage the inner surface 216*i* of secondary wellbore casing 216 to seal the annulus formed between casing 216 and straddle stimulation tool 285. A straddle depth mechanism 294 may be disposed along the outer surface 290 of the straddle tubular 286 adjacent the first end 286*a*, the straddle depth mechanism 294 engaging the first depth mechanism 248 of the frac window system 226. A second seal 296 may be provided on the outer surface 290 of the straddle tubular 286, the second seal 296 engaging the inner surface 234 of the elongated tubular 228 of the frac window system 226. Second seal 296 may engage one of the smooth the sealing surfaces 254 of elongated tubular 228 to ensure an effective or desirable seal.

In one or more embodiments, first seal 292 may be formed of multiple seal elements 298*a*, 298*b* such as first seal element 298*a* spaced apart from a second seal element 298*b*. A port 300 may extend from inner surface 289 to outer surface 290 between seal elements 298*a*, 298*b*.

In one or more embodiments, a production string, work string 293 or similar pressure casing may extend to the surface for delivery of a pressurized fluid. Work string 293 may stab into the upper end 228*a* of the frac window system 226 or may stab directly into the straddle stimulation tool 285. In the case where work string 293 directly engages straddle stimulation tool 285, e.g., at the end 286*a* of the straddle tubular 286, it will be appreciated that the work string 293 can engage the end of 286*a* of straddle tubular 286 so as to avoid subjecting the first wellbore casing 200 or the frac window system 226 to fluid pressures utilized in hydraulic fracturing of secondary wellbore 12*b*. Notably, lower secondary wellbore 12*a* may also be hydraulically fractured in this way (when main bore isolation sleeve 260 is in place and whipstock 276, straddle stimulation tool 285 and plug 274 are removed). In the case that the work string 293 stabs into the end 286*a* of the straddle tubular 286, the inside diameter of the work string 293 would be similar to, or less than, the inside diameter of the straddle tubular.

In the case where work string 293 may stab into the upper end 228*a* of the elongated tubular 228 of the frac window system 226, and with main bore isolation sleeve 260 in place, only the top section of elongated tubular 228 (above seal 296) will be subjected to fluid pressures utilized in hydraulic fracturing of lower secondary wellbore 12*a*. The first wellbore casing 200 will not be subjected to hydraulic fracturing pressures either. In this mode of operation, the inside diameter of the work string 293 may be relatively large to allow for a larger flow area.

Figure 9:
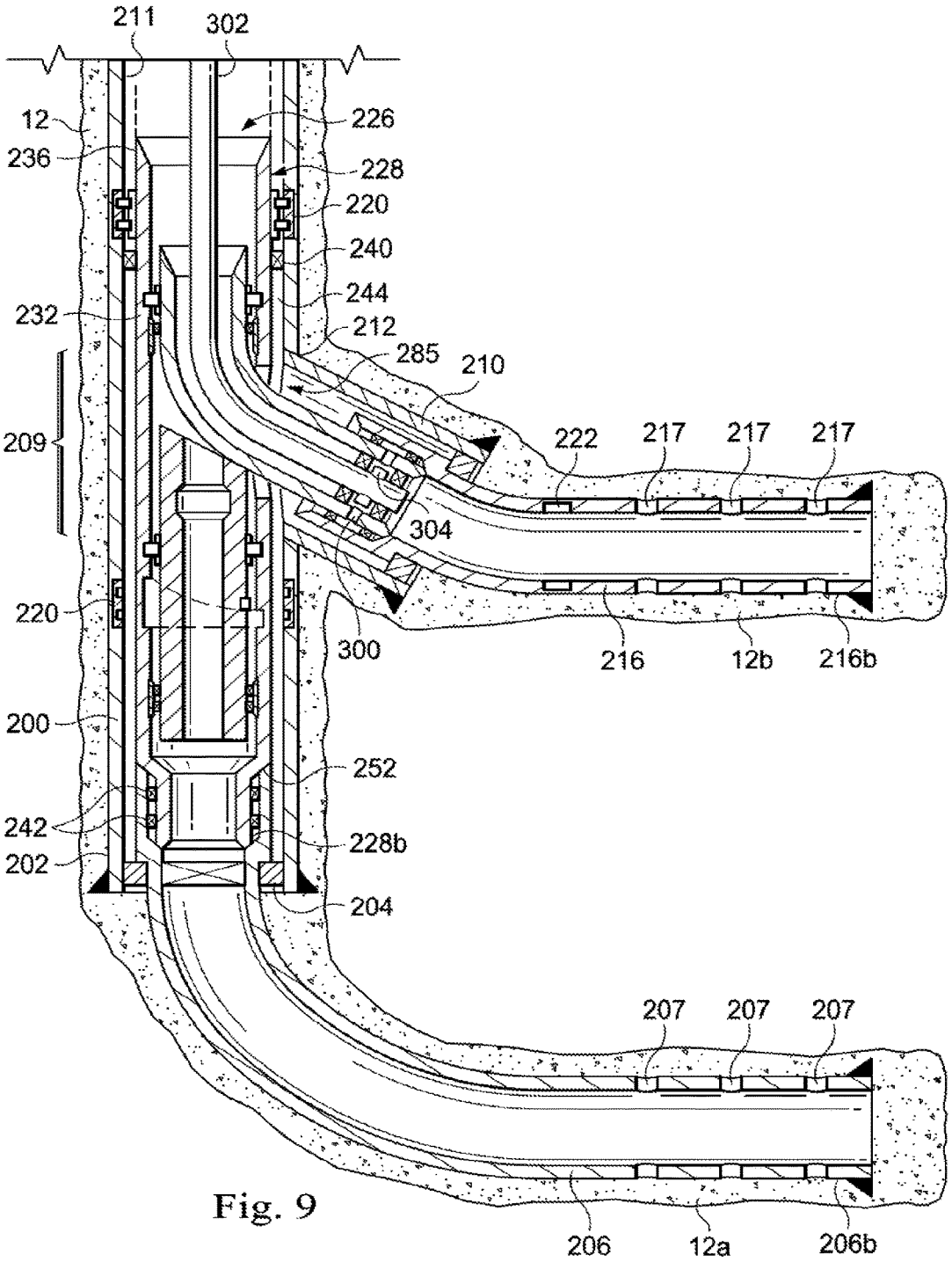
FIG. 9 is an elevation view in cross section of the frac window system of FIG. 4 illustrating the straddle stimulation tool of FIG. 8 being deployed and pressure tested by a SST running tool.

As shown in FIG. 9, the straddle stimulation tool 285 (SST) may be deployed and pressure tested by an SST running tool 302. The running tool 302 may engage straddle stimulation tool 285 and may be utilized to deploy straddle stimulation tool 285 as described above. Running tool 302 may include a pressurized fluid port 304 in fluid communication with the port 300 of the straddle stimulation tool 285 whereby a pressurized fluid may be delivered to the outer surface 290 of the straddle stimulation tool 285 to test or otherwise evaluate the first seal 292 between the secondary wellbore casing 216 and straddle stimulation tool 285.

It will be appreciated that when positioned as described above, the straddle stimulation tool 285 functions to isolate the portion of first wellbore 12 below window 212, including secondary wellbore 12*a*, from secondary wellbore 12*b*. The seals as described permit delivery of a high pressure fluid to upper secondary wellbore 12*b* without impacting lower secondary wellbore 12*a*. For example, hydraulic fracturing operations can be carried out with respect to upper secondary wellbore 12*b* without impacting lower secondary wellbore 12*a*. This might be desirable after one secondary wellbore 12*a*, 12*b* has been producing for some time and it is determined that only certain secondary wellbores within the system (such as secondary wellbore 12*b*) may need stimulation, while other secondary wellbores (such as secondary wellbore 12*a*) do not. In another example, since the vast majority of unconventional wellbores have to be stimulated before they will produce hydrocarbons, the foregoing will allow each of wellbores 12*a*, 12*b* to be isolated and hydraulically fractured in order to promote production. The straddle stimulation tool 285 and the main bore isolation sleeve 260 not only isolate the wellbores 12*a*, 12*b* from one another, but also provide a path for balls, plugs, etc. to be dropped from the surface to isolate individual zones in the wellbores during the stimulation process.

Figure 10:
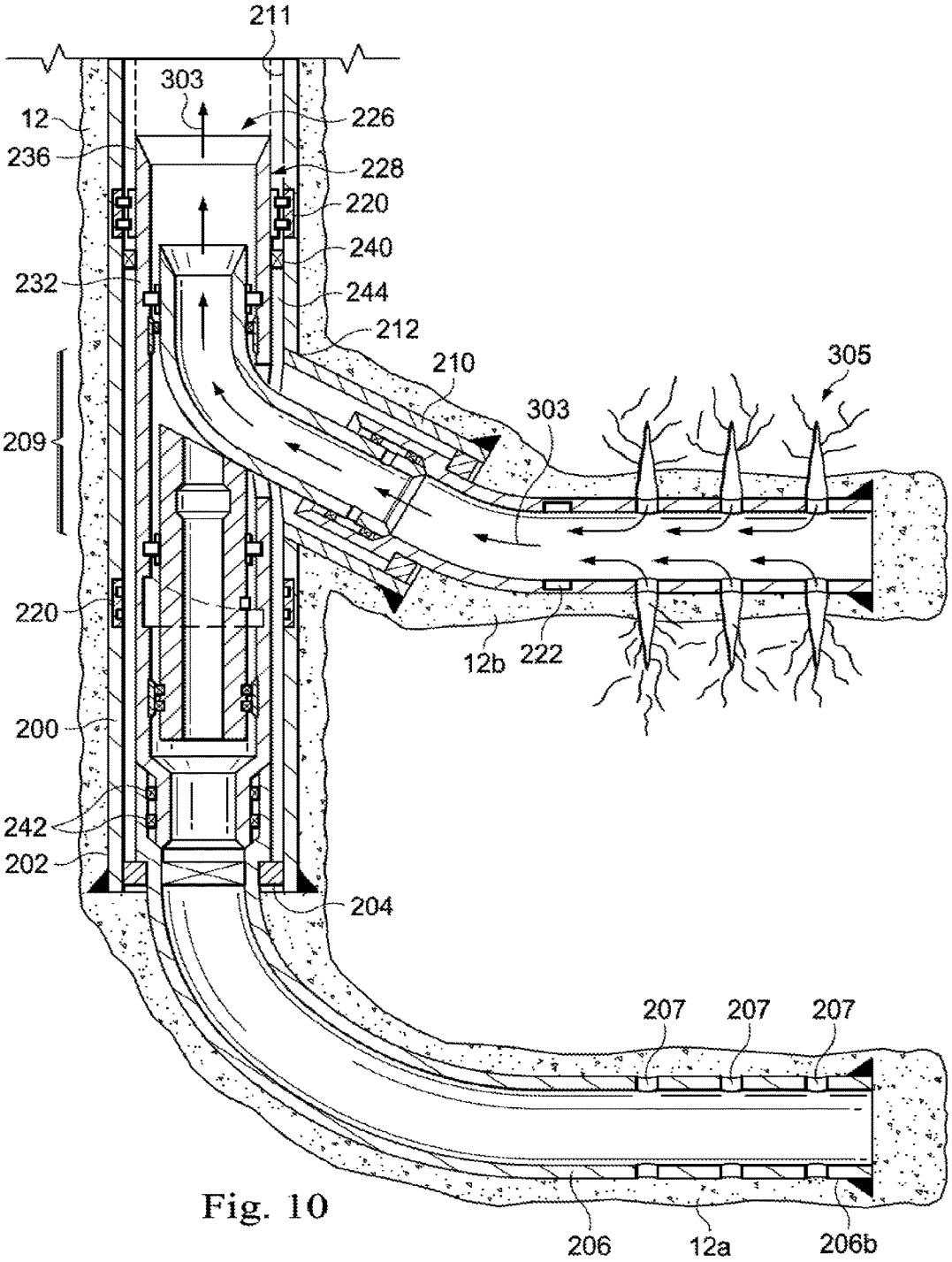
FIG. 10 is an elevation view in cross section of the frac window system of FIG. 4 illustrating production from the upper secondary wellbore of FIG. 3.

FIG. 10 illustrates production from the upper secondary wellbore 12*b* or flowback of fluids 303, such as hydraulic fracturing fluids and/or hydrocarbons, from fractures 305 resulting from such an operation, where flow from secondary wellbore 12*b* is illustrated while secondary wellbore 12*a* remains isolated.

It will be appreciated that when positioned as described above, the straddle stimulation tool 285 may function with, or without, seals 292 and/or 296 as a deployment tube or as a guide for tools to traverse from, for example, first wellbore 12 to secondary wellbore 12*b*. This can be an advantage when the tool(s) may consist of parts that may catch on the ends, edges or ledges of opening 230, casing windows 212, 210, and/or 216. For example, the bow-type spring centralizer of an electrical logging tool may have a tendency to conform to the inner surface or edges of 230, 212, 210, and/or 216 which could lead to the inability to pass the logging tool into or out secondary wellbore 12*a*. Another example is the passing of a packer from or to secondary wellbore 12*b*. Various parts of a packer may have a tendency to not pass through the inner surfaces or across the edges of items like 230, 212, 210, and/or 216.

Figure 11:
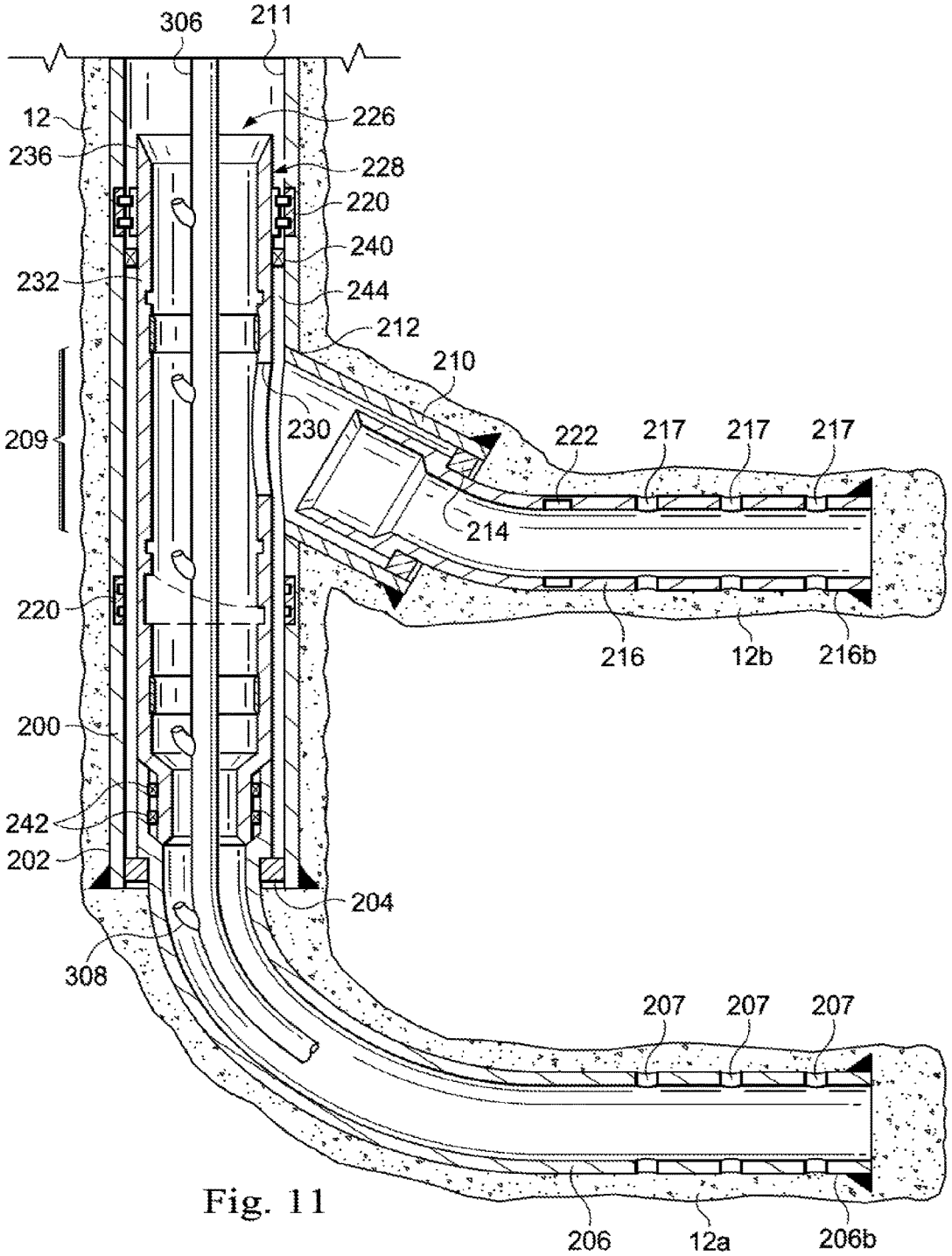
FIG. 11 is an elevation view in cross section of the frac window system of FIG. 4 illustrating a gas lift system deployed at least partially through the frac window system of the disclosure.
Figure 12:
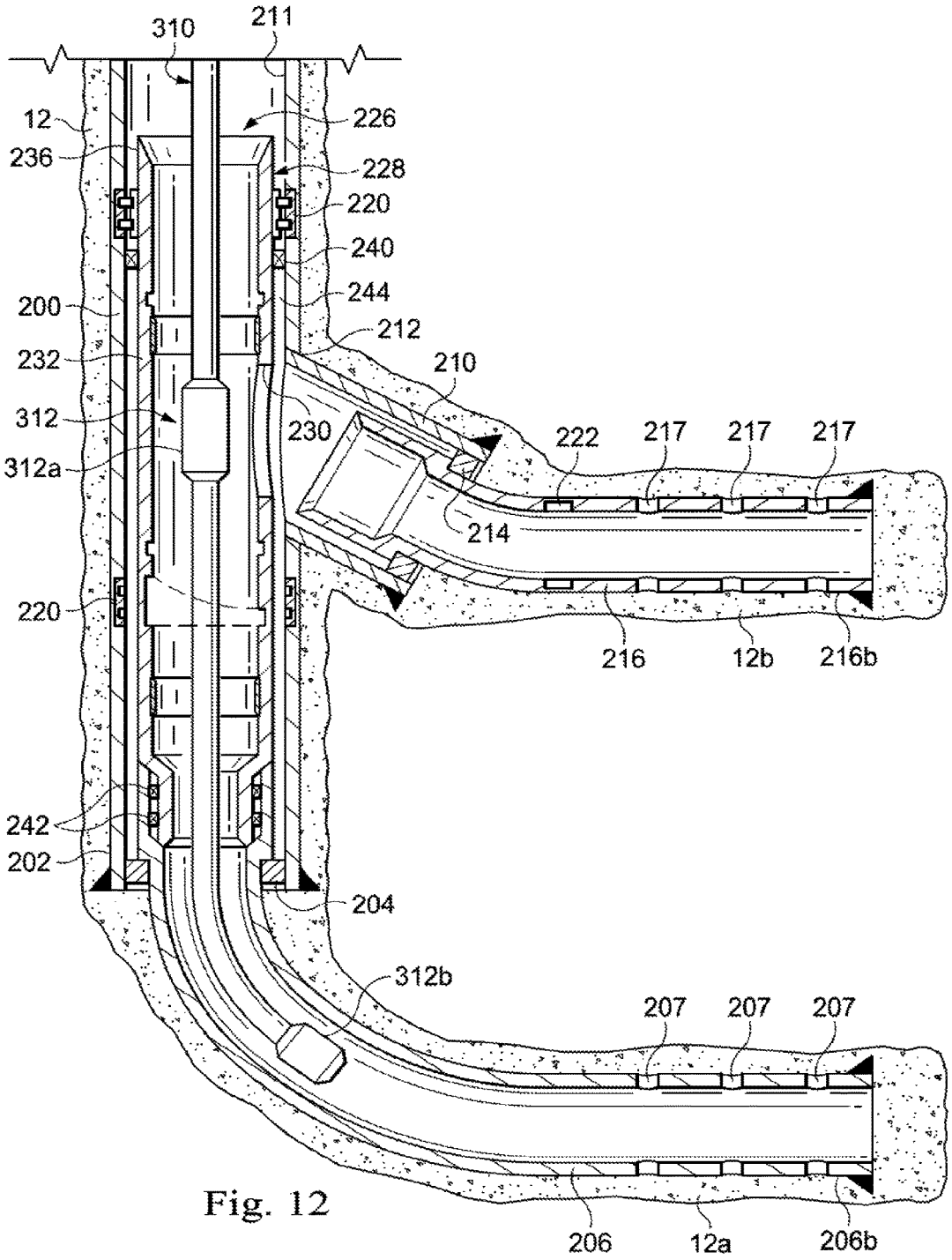
FIG. 12 is an elevation view in cross section of the frac window system of FIG. 4 illustrating a pump system deployed at least partially through the frac window system of the disclosure.

It will be appreciated that once installed, frac window system 226 may be removed upon completion of the various activities described herein. Alternatively, frac window system 226 may be left in place during the life of the wellbore 12. In such case, as shown in FIGS. 11 and 12, various equipment may be deployed within or extending through frac window system 226. In FIG. 11, a gas lift assembly 306 having gas ports 308 is shown deployed in first wellbore 12 and extending through elongated tubular 228 of frac window system 226. Likewise, in FIG. 12, a pump system 310 may be deployed in first wellbore 12 and extend at least partially through frac window system 226. In certain embodiments, pump system 310 may include a pump 312 deployed adjacent each secondary branch, such as pump 312*a* deployed adjacent lower secondary wellbore 12*a* and pump 312*b* deployed adjacent upper secondary wellbore 12*b*, while in other embodiments, pumps 312 may be located elsewhere within the secondary wellbores 12*a*, 12*b*. The foregoing equipment is not limited to a particular type of equipment or placement within a wellbore or, in the case of the pump system 310 and gas lift assembly 306, any particular type of pump system or lift assembly, respectively, but provided for illustrative purposes only.

Moreover, to the extent it is desired to perform an operation like pumping or gas lift only from either a lower portion of the first wellbore, a lower secondary wellbore or an upper secondary wellbore adjacent the frac window system, then the other portions of the wellbore may be isolated as described above prior to such operations. Thus, main bore isolation sleeve 260 (FIG. 5) may be re-deployed in wellbore 12, isolating upper secondary wellbore 12*b* and permitting gas lift or pumping only from lower secondary wellbore 12*a*. Alternatively, plug 274 (FIG. 6) may be set in order to isolate lower secondary wellbore 12*a* and permitting gas lift or pumping only from upper secondary wellbore 12*b*. It should be appreciated that the disclosure is not limited to any particular gas lift and/or pumping technologies. Other Artificial Lift technologies, secondary and tertiary recovery techniques not explicitly discussed herein may be employed without departing from the scope and spirit of the disclosure.

In any event, it will be appreciated that to the extent frac window system 226 is installed within first wellbore 12, it permits isolation of various secondary wellbores 12*a*, 12*b* as described herein. Moreover, to the extent opening 230 is smaller in size than the window 212 of first wellbore casing 200, then frac window system 226 also functions to prevent transition joint 210 from migrating back into first wellbore 12, where it could function as an impediment to operations in first wellbore 12.

It will be appreciated that any number of frac window systems 226 may be deployed along a first wellbore 12, thus permitting each secondary wellbore 12*b* . . . 12*n* (not shown) to be isolated from the first wellbore 12. Thus, in a system with "x" secondary wellbores extending from a first wellbore 12, x number of frac window systems 226 may be installed in first wellbore 12 so that a frac window system is deployed adjacent each of the secondary wellbores. In such case, a first wellbore 12 may have a plurality axially spaced casing windows 212 formed therein with a secondary wellbore extending from each casing window 212. In such case, a plurality of frac window systems 226 may be axially spaced apart along the length of the wellbore 12 so that a frac window system 226 is adjacent each casing window 212.

Figure 13:
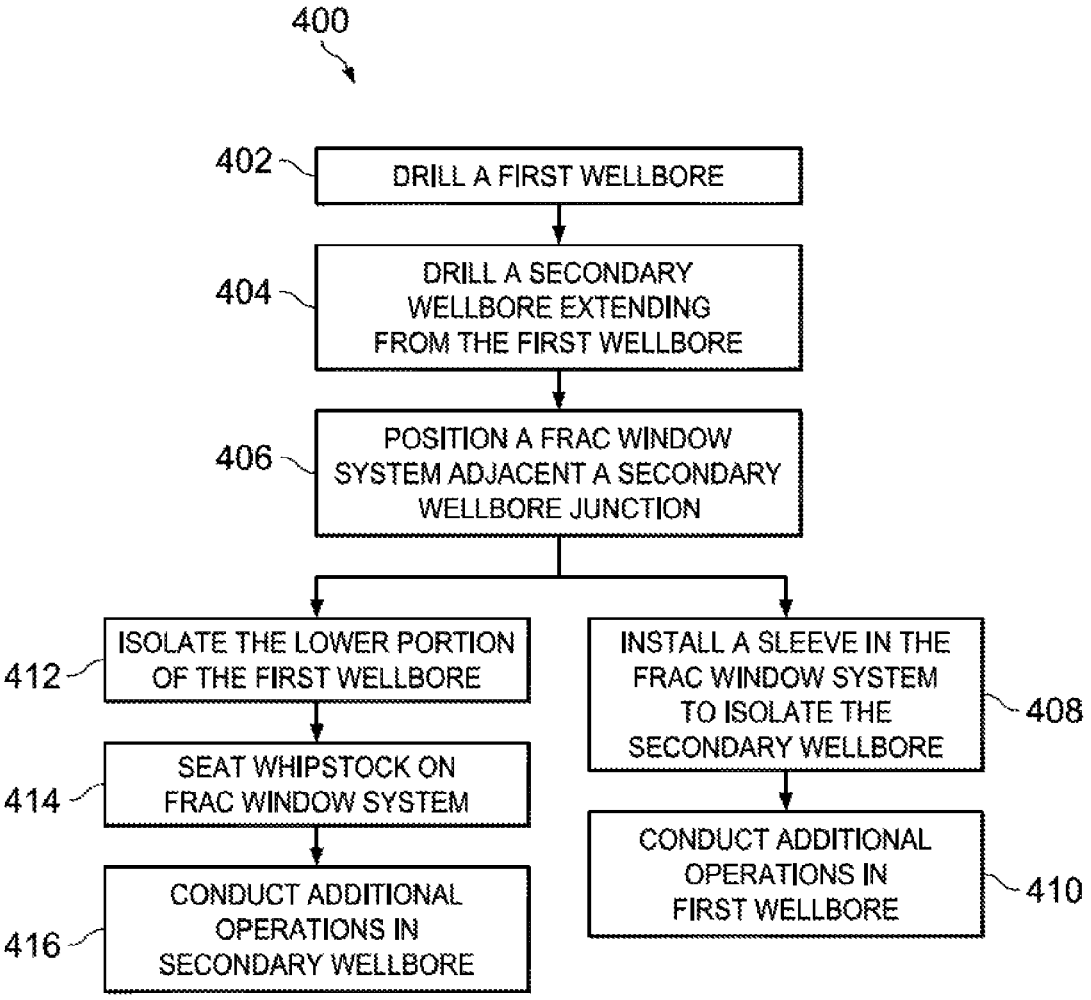
FIG. 13 is a flowchart that illustrates a method for servicing wells with multiple secondary wellbores.

Turning to FIG. 13, a method 400 of enhancing the production of hydrocarbons from a well system having one or more secondary or lateral wellbores is illustrated. As specified above, method 400 generally involves installation and use of a frac window system such as is described herein to isolate various parts of the wellbore system from other parts of the wellbore system, thus permitting various operations to be conducted without impacting the isolated part of the wellbore system. The method is particularly useful for high pressure pumping operations where it is desirable to limit exposure of the isolated part of the wellbore system to high pressure fluid. Such an operation might be employed to stimulate individual secondary wellbores in a well system that has been producing for a period of time without subjecting other secondary wellbores or another part of the first wellbore within a well system to the stimulation activities. In one or more embodiments, this method may also be employed to stimulate individual secondary wellbores in a well system that may not be producing hydrocarbons as desired, such as, for example, in a well drilled in an unconventional formation where the natural fractures are not large enough or plentiful enough to allow hydrocarbons to be produced by primary recovery methods.

Thus, at step 402, a first wellbore is drilled. In one or more embodiments, in step 402, the first wellbore is at least partially cased, after which, in step 404, one or more secondary wellbores are drilled. Such secondary wellbores may include secondary wellbores drilled from or at approximately the open or uncased distal end of the first wellbore, such as secondary wellbore 12*a* (FIG. 3), as well as, or alternatively, one or more secondary wellbores 12*b* (FIG. 3) drilled from a cased portion of the first wellbore. To the extent a secondary wellbore is drilled from a cased portion of the first wellbore, any standard techniques for drilling such a secondary wellbore may be employed. Such techniques may include milling a window in the first wellbore casing at a desired junction for the secondary wellbore, drilling a secondary wellbore into the formation from the window and casing the drilled secondary wellbore. In one or more embodiments, the first wellbore may be a "main" wellbore or it may be a "lateral" wellbore, depending on the secondary wellbore to be drilled. Thus, in one or more embodiments, the "first" wellbore may be a lateral wellbore drilled off of a main wellbore and the "second" wellbore is a "twig" wellbore. In the event that a first wellbore already exists, step 402 may be omitted or modified.

In this same vein, in the event that a secondary wellbore already exists, step 404 may likewise be omitted.

In step 406, with a secondary wellbore in place, a frac window system (or multiple frac window systems) may be run-in and positioned adjacent the junction with the secondary wellbore extending from the cased first wellbore. In this step an opening in frac window system is aligned with the casing window of the first wellbore casing. In one or more embodiments, by positioning the frac window system so that an opening in the frac window system is aligned with the window of the casing, and an orientation device disposed along the inner surface is below the window, i.e., below the secondary wellbore junction. The annulus between the frac window system tubular and the first wellbore casing is sealed once the frac window system is in position. This step of sealing may include sealing the annulus above and below the opening in the frac window system.

Once the frac window system is installed, in one or more embodiments, in a step 408, a sleeve may be positioned along the interior surface of the tubular adjacent the opening in the frac window system in order to isolate the secondary wellbore 12*b* adjacent the frac window system. In some embodiments, the sleeve may be installed in the frac window system at the surface, and then both may be run into the wellbore at the same time to save a trip. In this regard, the annulus between the sleeve and the tubular of the frac window system may be sealed. In this step, such sealing may comprise sealing the annulus above and below the opening in the frac window system tubular wall.

In one or more embodiments, with the secondary wellbore 12*b* isolated, at step 410, various operations within the first wellbore and/or other secondary wellbores can be conducted without impacting the isolated secondary wellbore. Such operations may include drilling an additional secondary wellbore extending from the first wellbore or extending an existing secondary wellbore 12*a*, 12*b*. This additional secondary wellbore may be drilled from an uncased portion of the distal end of the first wellbore, either from an uncased wall or through the open end of a cased first wellbore or through a casing window in the first wellbore. The additional secondary wellbore may be cased or otherwise lined for production as is well known in the art. In another embodiment, the additional secondary wellbore may left as an open hole. Alternatively or in additional thereto, such various operations may include pumping operations, such as hydraulic fracturing or re-fracturing, perforating, acidizing or other operations. Thus, in some cases, one or more secondary wellbores may be isolated while another secondary wellbore may be hydraulically fractured independently of the isolated wellbore.

In one or more embodiments, at step 412, the lower portions of the first wellbore below the junction with a secondary wellbore are isolated or sealed from the junction of the secondary wellbore. This isolation may be accomplished by installing a plug in the first wellbore below the secondary wellbore junction. The plug may be run-in and on the same nm as step 406, or the plug may be run in and set at a different time.

As an alternative to positioning a sleeve as described above in step 408, in step 414, a whipstock is deployed in the first wellbore and seated on the frac window system. In one or more embodiments, the whipstock is seated so that a guide surface or contoured surface of the whipstock faces in the direction of the window in the first wellbore casing. A follower or similar device on the whipstock may move along an orientation mechanism, such as an orientation device 238 (FIG. 4), of the frac window system in order axially and radially position the whipstock in the first wellbore.

In one or more embodiments, with the lower portion of the first wellbore isolated, at step 416, the whipstock is utilized to conduct various operations within the secondary wellbore 12*b*. Such operations may be conducted without impacting the isolated portion of the first wellbore. Such operations may include additional drilling of the secondary wellbore 12*b*, such as to extend the secondary wellbore 12*b*, or various pumping operations, such as hydraulic fracturing or re-fracturing, perforating, acidizing or other operations. Thus, in some cases, one or more secondary wellbore may be isolated while another secondary wellbore may be hydraulically fractured independently of the isolated wellbore.

In any event, once the frac window system is installed, one portion of the wellbore system may be isolated from another portion while operations are performed. In some embodiments, the operations are high pressure fracturing operations. In some embodiments, an upper secondary wellbore is isolated from a lower secondary wellbore by installing the isolation sleeve in the frac window system so that the isolation sleeve seals or otherwise blocks fluid communication between the first wellbore and the upper secondary wellbore. Once isolated, the pumping operations to the lower secondary wellbore utilizing the first wellbore can be conducted, such as injecting pressurized fluid into the lower secondary wellbore.

Over the life of first wellbore 12, frac window system 226 may remain in place, and it may further be desirable to remove and install main bore isolation sleeve 260 and/or whipstock 276 one or more times to perform various operations where it would be desirable to isolate either a first wellbore portion or a secondary wellbore as described herein. For example, debris may accumulate within a secondary wellbore, such as secondary wellbore 12*b*, and it may be necessary to deploy whipstock 276 in order to conduct operations within secondary wellbore 12*b* to remove the debris. Likewise, perforations 217 in the secondary wellbore casing 216 may have become clogged over time and require clearing.

Likewise, over the life of the first wellbore 12, frac window system 226 may be removed and subsequently reinstalled one or more times to perform various operations where it would be desirable to isolate either a first wellbore portion or a secondary wellbore as described herein.

It will be appreciated by one skilled in the art that certain steps in method 400 may be re-arranged or omitted without deviating from the scope of the disclosure. For example, step 402 may have been performed prior to the use of the methods and devices described herein; therefore step 402 may be modified or omitted.

Likewise, additional steps may be added to method 400 without deviating from the disclosure. For example, one or more windows may be milled in the first wellbore casing before step 404 occurs. Also, an existing open-hole secondary wellbore may be acid washed prior to performing any one of the steps.

Likewise, additional steps may be added to method 404 without deviating from the disclosure. For example, one or more windows may be milled in the first wellbore casing and secondary wellbores drilled before step 406 occurs.

Likewise, the numerical order of steps does not necessarily have to be sequential. For example, step 410 may be performed prior to step 408.

In addition, method 400, and/or some of the steps thereof, may be repeated in any sequence desired to create additional secondary wellbores extending from a first wellbore (including branches and/or twigs).

Thus, a wellbore assembly has been described. Embodiments of the wellbore assembly may generally include a first wellbore casing string having a window formed along the casing string and defining an interior annulus; a frac window system disposed within the first wellbore casing, the frac window system comprising an elongated tubular having a first and or second end with an opening defined in a wall of the tubular between the two ends, the wall having an inner surface and an outer surface; an orientation device disposed along the inner surface; and a first seal disposed along the outer surface between the window and the first end and a second seal disposed along the outer surface between the window and the second end; wherein the opening of the frac window system is aligned with the window of the first wellbore casing string. Other embodiments of a wellbore assembly may generally include a first wellbore casing string having a window formed along the casing string and defining an interior annulus; a frac window system disposed within the first wellbore casing, the frac window system comprising an elongated tubular having a first and or second end with an opening defined in a wall of the tubular between the two ends, the wall having an inner surface and an outer surface; an orientation device disposed along the inner surface; and a first seal disposed along the outer surface to seal between the frac window system and the casing string, wherein the opening of the frac window system is aligned with the window of the first wellbore casing string. Other embodiments of a wellbore assembly may generally include first wellbore casing string having a window formed along the casing string and defining an interior annulus; a frac window system disposed within the first wellbore casing, the frac window system comprising an elongated tubular having a first and or second end with an opening defined in a wall of the tubular between the two ends, the wall having an inner surface and an outer surface; and an orientation device disposed along the inner surface; a first seal disposed along the outer surface to seal between the frac window system and the casing string; wherein the opening of the frac window system is aligned with the window of the first wellbore casing string. Other embodiments of a wellbore assembly may generally include a frac window system having an elongated tubular with a first and a second end with an opening defined in a wall of the tubular between the two ends, the wall having an inner surface and an outer surface; an orientation device disposed along the inner surface; a first seal disposed along the outer surface; and a whipstock disposed in the tubular between the tubular opening and the second end of the tubular. Other embodiments of a wellbore assembly may generally include frac window system having an elongated tubular with a first and a second end with an opening defined in a wall of the tubular between the two ends, the wall having an inner surface and an outer surface; an orientation device disposed along the inner surface; a first seal disposed along the outer surface; and a main bore isolation sleeve disposed in the tubular adjacent the opening.

For any of the foregoing embodiments, the wellbore assembly may include any one of the following elements, alone or in combination with each other:

An engagement mechanism mounted on the outer surface of the elongated tubular.

The engagement mechanism is mounted on the outer surface of the elongated tubular and is engaged with a mating engagement mechanism disposed along the interior annulus of the first wellbore casing string, wherein the mating engagement mechanism of the first wellbore casing string is above said window and latch of frac window system is between opening and first end of the tubular.

The engagement mechanism is between the first seal element and the first end of the tubular.

A first depth mechanism disposed along inner surface of the tubular between the opening and first end.

An orientation depth mechanism disposed along inner surface adjacent said orientation device.

The inner and outer surfaces adjacent to an end of the elongated tubular are smooth.

The inner and outer surfaces adjacent both ends are smooth.

The inner surface adjacent at least one end is smooth.

The inner surface adjacent both ends is smooth.

The outer surface adjacent at least one end is smooth.

The outer surface adjacent both ends is smooth.

The orientation device is selected from the group consisting of a scoop head, a muleshoe or a ramped surface.

At least one seal comprises an elastomeric element.

At least one seal is a metal to metal seal.

A seal comprises a shoulder formed along the outer surface of said tubular and a shoulder formed by a casing string.

A main bore isolation sleeve, the main bore isolation sleeve comprising a tubular sleeve having a first and a second end, an inner surface and an outer surface; first and second spaced apart seals disposed on the outer surface of the tubular sleeve; and a depth mechanism disposed along the outer surface of the sleeve, wherein said sleeve is positioned along inner surface of the elongated tubular so that the first end of sleeve is above the opening in the tubular and the second end of sleeve is below the opening in the tubular and the depth mechanism of the main bore isolation sleeve engages a first depth mechanism disposed along the inner surface of the elongated tubular.

The depth mechanism of the frac window system engages the first depth mechanism along the inner surface of the tubular.

A plug is disposed adjacent the second of the elongated tubular.

The plug is within the tubular.

The plug is below the tubular.

A whipstock is disposed in the tubular.

The whipstock is disposed between tubular opening and second end of the tubular.

The whipstock comprises a first end having a contoured surface and a second end, and a depth mechanism disposed to engage the orientation depth mechanism of the frac window system.

The whipstock further comprises a follower disposed to engage the orientation device.

A straddle stimulation tool having a straddle tubular with a first end, a second end, an inner surface and an outer surface, the straddle stimulation tool extending through the opening of the frac window system and the casing window, wherein the first end is positioned in the frac window system.

A secondary wellbore casing string having an interior surface and a proximal end adjacent the window of the first wellbore casing string, the straddle stimulation tool positioned so that the second end is in the secondary wellbore casing string, the straddle stimulation tool further comprising a first seal on the outer surface of the straddle tubular, the first seal engaging the interior surface of the secondary wellbore casing string.

A straddle depth mechanism along the outer surface of the straddle tubular adjacent the first end, the straddle depth mechanism engaging the first depth mechanism of the frac window system.

The second seal on the outer surface of the straddle tubular, the second seal engaging the inner surface of the elongated tubular of the frac window system.

The first seal comprises first and second seal elements spaced apart from one another adjacent the straddle tubular second end and a port extending from the inner surface to the outer surface of the straddle tubular between the two seal elements.

A running tool engaging the straddle stimulation tool.

The running tool comprises a pressurized fluid port in fluid communication with the port of the straddle stimulation tool.

A gas lift assembly extending at least partially through the frac window system.

A pump system extending at least partially through the frac window system.

A pump system comprises a first pump adjacent the window and a second pump below the second end of the frac window system.

The engagement mechanism is selected from the group consisting of a latch, an anchor, a packer, and a slip.

A method of stimulating a petroleum well has been described. Embodiments of wellbore stimulation methods may include drilling a first wellbore and at least partially casing the first wellbore; drilling a secondary wellbore extending from a cased portion of the first wellbore; positioning a tubular in the first wellbore so that an opening in the tubular wall aligns with the secondary wellbore; and sealing the annulus between the tubular and the first wellbore. Likewise, a stimulation method for a petroleum well has been described that may include drilling a first wellbore and at least partially casing the first wellbore; drilling a first secondary wellbore extending from a cased portion of the first wellbore; drilling another secondary wellbore extending from the first wellbore; positioning a tubular in the first wellbore so that an opening in the tubular wall aligns with the first secondary wellbore junction; positioning a sleeve along the interior surface of the tubular to cover the opening and isolate the first secondary wellbore from fluid communication with the first wellbore; performing pressurized fluid operations in the other secondary wellbore while the first secondary wellbore remains isolated; removing the sleeve from the tubular to establish fluid communication between the first wellbore and the first secondary wellbore; and installing a plug below the opening in the tubular to isolate the other secondary wellbore from the first wellbore; and performing pressurized fluid operations in the first secondary wellbore while the other secondary wellbore remains isolated.

For the foregoing embodiments, the method may include any one of the following steps, alone or in combination with each other:

Sealing the annulus above and below the junction of the secondary wellbore and the first wellbore.

Sealing the annulus between the sleeve and the tubular to isolate the secondary wellbore from fluid communication with the first wellbore.

Sealing the annulus between the sleeve and the tubular comprises sealing the annulus above and below the opening in the tubular wall.

Drilling an additional secondary wellbore extending from the first wellbore.

The additional secondary wellbore extends from the distal end of the first wellbore.

The additional secondary wellbore extends from a cased portion of the first wellbore spaced apart from the other secondary wellbore.

Installing a liner in the secondary wellbore.

Drilling an additional secondary wellbore extending from the first wellbore and introducing a pressurized fluid into the first wellbore and the additional secondary wellbore.

Injecting a hydraulic fracturing fluid into the additional secondary wellbore while maintain the other secondary wellbore isolated from the pressurized fluid.

The additional secondary wellbore is a lower portion of the first wellbore.

The additional secondary wellbore is a lateral portion of the first wellbore.

Installing a liner in the additional secondary wellbore.

Supporting the liner from the lower end of the first wellbore casing.

Installing the tubular utilizing a pipe string manipulated by a drilling rig or workover rig.

Removing drilling equipment utilized to drill the first wellbore and producing hydrocarbons from the first wellbore for a period of time after the drilling equipment is removed, and thereafter, positioning the sleeve to isolate the secondary wellbore.

Engaging a latch mounted of the exterior of the tubular with a latch coupling carried by the first wellbore casing.

Aligning the tubular opening with a window in the first wellbore casing.

Engaging a vertical orientation device of sleeve with a vertical orientation device of the tubular.

Positioning the sleeve in the tubular before the tubular is positioned in first wellbore.

Drilling a secondary wellbore extending from the first wellbore, isolating one of the first or secondary wellbores from the other wellbore; and injecting a pressurized fluid into the other wellbore.

Installing the sleeve with an installation vehicle selected from the group consisting of coiled tubing, slickline, wireline, flexible pipe and flexible cable.

Setting a packer in the annulus space above the window and engaging the inner surface of the tubular with a sealing element below the window.

Drilling a secondary wellbore extending from the first wellbore; isolating a portion of the first wellbore from the secondary wellbore; and injecting a pressurized fluid into the secondary wellbore.

Drilling a secondary wellbore extending from the first wellbore; isolating the secondary wellbore from the first wellbore; and injecting a pressurized fluid into the first wellbore.

Removing the isolation sleeve from tubular to establish fluid communication between the first wellbore and a secondary wellbore.

Isolating the secondary wellbore by setting a plug below the first wellbore junction.

Setting the plug during the same run-in where the sleeve is removed.

Setting the plug adjacent the end of tubular.

Setting the plug within tubular.

Setting the plug below the tubular in first wellbore casing.

Positioning a whipstock along the interior surface of the tubular in proximity to the first wellbore junction with the secondary wellbore.

Positioning a contoured upper end of whipstock adjacent the opening in said tubular.

Engaging depth mechanism along the exterior of the whipstock with a depth mechanism positioned along the interior of the tubular.

Engaging an orientation mechanism on the whipstock with an orientation mechanism positioned along the interior of the tubular.

Utilizing a lug on the whipstock to follow the contoured surface of tubular to rotate the whipstock until the contoured surface of whipstock faces the secondary wellbore.

Positioning a straddle stimulation tubular through the opening of the tubular to create a sealed, pressurized fluid flow path between the first wellbore and the secondary wellbore.

Sealing the annulus between the straddle stimulation tubular and a liner in the secondary wellbore.

Positioning the straddle stimulation tubular comprises installing the straddle stimulation tubular with an installation vehicle selected from the group consisting of coiled tubing, slickline, wireline, flexible pipe and flexible cable.

The sealed flowpath extends from a location upstream of the opening to a location in the secondary wellbore.

Pressure testing the seals between the outer surface of straddle stimulation tubular and the liner of the secondary wellbore.

Fracturing a first secondary wellbore while maintaining isolation of an additional secondary wellbore extending from the first wellbore.

Production testing the first wellbore while the secondary wellbore remains isolated.

Removing the straddle stimulation tubular and whipstock from wellbore.

Determining the pressure balance of the first wellbore by comparing formation pressure about the first wellbore and the hydrostatic pressure within the secondary wellbore.

Withdrawing the straddle stimulation tubular and whipstock from the first wellbore, and if a determination is made that the first wellbore is underbalanced, performing a balancing operation.

Setting a plug in the first wellbore and then withdrawing the straddle stimulation tubular and whipstock from the first wellbore.

Removing a plug isolating a secondary wellbore and allowing comingling of hydrocarbon produced from each of two secondary wellbores.

Positioning a gas lift system to extend at least partially through the tubular and injecting gas into at least one wellbore to enhance hydrocarbon production.

Positioning a pump system to extend at least partially through the tubular and pumping hydrocarbons from the wellbore.

Positioning a whipstock along the interior surface of the tubular in proximity to the first secondary wellbore junction with the first wellbore; utilizing the whipstock to position a straddle stimulation tubular through the opening of the tubular to create a sealed, pressurized fluid flow path between the first wellbore and the first secondary wellbore.

Utilizing the tubular in the first wellbore to inhibit migration of equipment from the first secondary wellbore into the first wellbore.

Utilizing the tubular in the first wellbore to inhibit migration of equipment from the first wellbore into the first secondary wellbore.

Utilizing the tubular in the first wellbore to enhance migration of equipment from the first wellbore into the first secondary wellbore.

Utilizing the tubular of the frac window system to secure a transition joint tubular in a secondary wellbore.

Removing drilling equipment utilized to drill the oil and gas well and producing hydrocarbons from the oil and gas well for a period of time after the drilling equipment is removed, and thereafter, positioning a plug in the first wellbore to isolate a secondary wellbore from the first wellbore.

Removing drilling equipment utilized to drill the well and producing hydrocarbons from the oil and gas wellbore for a period of time after the drilling equipment is removed, and thereafter, simultaneously running a whipstock and plug into the first wellbore and positioning a plug to isolate a secondary wellbore from the first wellbore.

Engaging an anchoring device mounted on the exterior of the tubular with the inner wall of the first wellbore casing.

Aligning the opening of a frac window system with a window in the first wellbore casing.

Positioning a sleeve along the interior surface of the tubular and sealing the annulus between the sleeve and the tubular to isolate a secondary wellbore from fluid communication with the first wellbore, wherein positioning the sleeve comprises engaging a depth mechanism of the sleeve with a first depth mechanism of the tubular.

Positioning a sleeve along the interior surface of the tubular and sealing the annulus between the sleeve and the tubular to isolate a secondary wellbore from fluid communication with the first wellbore, wherein the sleeve is positioned in the tubular before the tubular is positioned in first wellbore.

Drilling another secondary wellbore extending from the first wellbore; isolating one of the secondary wellbores from the other secondary wellbore; and injecting a pressurized fluid into the other secondary wellbore.

Installing the sleeve with an installation vehicle selected from the group consisting of coiled tubing, slickline, wireline, flexible pipe and flexible cable.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

The invention claimed is:

1. A wellbore stimulation assembly comprising:

a first wellbore casing defining an interior annulus and having a window formed therealong;

a frac window system disposed within the first wellbore casing, the frac window system including an elongated tubular having a first end and a second end with an opening defined in a wall of the elongated tubular between the two ends of the elongated tubular, the wall having an inner surface and an outer surface, and the opening in the wall aligned with the window of the first wellbore casing;

a first seal and a second seal disposed along the outer surface of the wall, the first seal disposed between the window and the first end and the second seal disposed between the window and the second end;

an orientation device disposed along the inner surface of the wall of the elongated tubular below the opening, the orientation device operable to engage a follower on an outer surface of a first tool to axially and radially orient the first tool in the elongated tubular;

a first depth mechanism disposed along the inner surface of the wall of the elongated tubular above the opening, the first depth mechanism operable to receive a first end of a second tool above the opening to releasably secure the second tool within the elongated tubular; and a second depth mechanism disposed along the inner surface of the wall of the elongated tubular below the opening, the second depth mechanism operable to secure a second end of a third tool below the opening to releasably secure the third tool within the elongated tubular.

2. The assembly of claim 1, further comprising a first engagement mechanism mounted on the outer surface of the elongated tubular and releasably engaged with a second engagement mechanism disposed along the interior annulus of the first wellbore casing, wherein the second engagement mechanism is above the window and wherein the first engagement mechanism is disposed between the opening and the first end of the tubular.

3. The assembly of claim 1, where each of the inner and outer surfaces adjacent to at least one of the first end and second end of the elongated tubular are smooth.

4. The assembly of claim 1, wherein the orientation device is selected from the group consisting of a scoop head, a muleshoe or a ramped surface.

5. The assembly of claim 1, further comprising a main bore isolation sleeve, the main bore isolation sleeve comprising a tubular sleeve having a first end and a second end, an inner surface and an outer surface, first and second spaced apart seals disposed on the outer surface of the tubular sleeve, and at least one depth mechanism disposed along the outer surface of the sleeve engaged with at least one of the first and second depth mechanisms disposed along the inner surface of the wall of the elongated tubular, wherein the sleeve is positioned along inner surface of the elongated tubular so that the first end of the sleeve is above the opening in the tubular and the second end of sleeve is below the opening in the tubular.

6. The assembly of claim 5, wherein the at least one depth mechanism of the main bore isolation sleeve engages the first depth mechanism along the inner surface of the wall of the elongated tubular.

7. The assembly of claim 1, further comprising a whipstock disposed in the elongated tubular, wherein the whipstock is disposed between the opening of the elongated tubular and the second end of elongated tubular, and wherein a follower on an outer surface of a the whipstock is engaged with the orientation device in the elongated tubular.

8. The assembly of claim 7, further comprising a straddle stimulation tool having a straddle tubular with a first end, a second end, an inner surface and an outer surface, the straddle tubular extending through the opening of the frac window system and the window of the first wellbore casing, wherein the first end of the straddle tubular is positioned in the frac window system and secured to the first depth mechanism disposed along the inner surface of the wall of the elongated tubular.

9. The assembly of claim 8, wherein the straddle stimulation further comprises a first seal having first and second seal elements spaced apart from one another adjacent the straddle tubular second end and a port extending from the inner surface to the outer surface of the straddle tubular between the two seal elements.

10. The assembly of claim 1, further comprising at least one of a gas lift assembly and a pump system extending at least partially through the frac window system and a production string sealingly and releasably engaged with the first end of the elongated tubular.

11. A wellbore stimulation method, the method comprising:

positioning an elongated tubular in a cased portion of a first wellbore;

orienting the elongated tubular so that an opening in the elongated tubular aligns with a junction of a secondary wellbore extending from the cased portion of the first wellbore;

sealing an annulus between the tubular and the first wellbore;

securing an isolation sleeve to at least one of a first depth mechanism disposed along an inner surface of the elongated tubular above the opening and a second depth mechanism disposed along the inner surface of the elongated tubular below the opening;

sealing an annulus between the isolation sleeve and the elongated tubular to isolate the secondary wellbore from fluid communication with the first wellbore;

introducing a pressurized fluid into the first wellbore through the isolation sleeve while maintaining the secondary wellbore isolated from the pressurized fluid;

removing the isolation sleeve from the elongated tubular while the elongated tubular remains in the first wellbore to thereby establish fluid communication between the first wellbore and the secondary wellbore through the opening;

orienting a whipstock within the elongated tubular by engaging a follower on the whipstock with an orientation device disposed along the inner surface of the wall of the elongated tubular below the opening;

guiding a straddle stimulation tool through the opening of the elongated tubular with the whipstock;

securing the straddle stimulation tool to the to the first depth mechanism disposed along an inner surface of the elongated tubular to create a sealed, pressurized fluid flow path between the first wellbore and the secondary wellbore; and introducing a pressurized fluid into the secondary wellbore through the straddle stimulation tool.

12. The method of claim 11, wherein sealing the annulus further comprises sealing the annulus above and below the junction of the secondary wellbore and the first wellbore.

13. The method of claim 11, wherein introducing the pressurized fluid into the first wellbore further comprises injecting a hydraulic fracturing fluid into the first wellbore to thereby hydraulically fracture the first wellbore.

14. The method of claim 11, further comprising producing hydrocarbons from the first wellbore for a period of time prior to positioning the sleeve to isolate the secondary wellbore.

15. The method of claim 11, further comprising setting a plug below the junction of the first wellbore with the secondary wellbore to fluidly isolate the secondary wellbore from a portion of the first wellbore below the plug.

16. The method of claim 11, further comprising sealing an annulus between the straddle stimulation tool and a liner in the secondary wellbore.

* * * * *